US009636930B1

(12) United States Patent
Leighton et al.

(10) Patent No.: US 9,636,930 B1
(45) Date of Patent: May 2, 2017

(54) TRANSPORT WITH MEDIA HOLD DOWN FOR INKJET PRINTERS

(71) Applicant: Xerox Corporation, Norwalk, CT (US)

(72) Inventors: Roger G. Leighton, Hilton, NY (US); Michael F. Leo, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/150,841

(22) Filed: May 10, 2016

(51) Int. Cl.

| | |
|---|---|
| ***B41J 11/00*** | (2006.01) |
| ***B41J 13/10*** | (2006.01) |
| ***B65H 5/08*** | (2006.01) |
| ***B41J 13/16*** | (2006.01) |
| ***B65H 29/04*** | (2006.01) |
| ***B41J 13/22*** | (2006.01) |
| ***B65H 29/02*** | (2006.01) |

(52) U.S. Cl.
CPC ..... *B41J 11/007* (2013.01); *B41J 13/10* (2013.01); *B41J 13/16* (2013.01); *B41J 13/22* (2013.01); *B65H 5/085* (2013.01); *B65H 29/02* (2013.01); *B65H 29/04* (2013.01)

(58) Field of Classification Search
CPC ..... B65H 5/085; B65H 29/02; B65H 29/04; B65H 5/02; B65H 5/14; B65H 2404/34; B65H 29/003; B65H 29/005; B65H 29/045; B65H 29/06; B41J 13/10; B41J 13/22; B41J 11/007; B41J 13/16; B41J 13/24
See application file for complete search history.

(56) References Cited

U.S. PATENT DOCUMENTS

| | | | | | |
|---|---|---|---|---|---|
| 3,881,229 | A * | 5/1975 | Reid | D06C 3/025 | 226/173 |
| 4,276,978 | A * | 7/1981 | Deguchi | G03G 15/6529 | 198/803.1 |
| 6,067,883 | A * | 5/2000 | Cote | B65H 29/044 | 83/155 |
| 6,129,350 | A * | 10/2000 | St. Ours | B41F 13/03 | 198/644 |
| 8,919,950 | B2 * | 12/2014 | Veis | B41J 11/007 | 347/101 |
| 2005/0062219 | A1 * | 3/2005 | Forch | B65H 29/041 | 271/204 |
| 2015/0344249 | A1 * | 12/2015 | Inoue | B65H 29/52 | 347/102 |

* cited by examiner

*Primary Examiner* — Henok Legesse
(74) *Attorney, Agent, or Firm* — BudzynFortunato IP Law, LLC

(57) ABSTRACT

A transport with media hold down is used with an inkjet printer. A plurality of spar links and vacuum links are connected pivotally together to form an endless belt orbiting around drive wheels and driven wheels. Vacuum links have hollow chambers to hold the media sheet against the endless belt using vacuum. At least one spar is received in a slot on a spar link. The spar extends above the link to receive the media sheet. The spar moves into a clamping position by a cam and follower to clamp the media sheet against the spar link. The media sheet will thus pass beneath the inkjet print head without contact. The spar moves into an extended position by the cam and follower to release the media sheet. The spar moves into a retracted position below the spar link surface by the cam and follower to allow the media sheet to exit the transport.

24 Claims, 28 Drawing Sheets

TRANSPORT WITH MEDIA HOLD DOWN FOR INKJET PRINTERS

INCORPORATION BY REFERENCE

Not applicable.

TECHNICAL FIELD

This invention relates to inkjet digital printing machines, and, more particularly, to an apparatus, system, and method for protecting the printing head from damage due to impaction of media sheets by clamping the lead edge of the media down against the transport.

BACKGROUND

Digital printing machines can take on a variety of configurations. One common process is that of electrostatographic printing, which is carried out by exposing a light image of an original document to a uniformly charged photoreceptive member to discharge selected areas. A charged developing material is deposited to develop a visible image. The developing material is transferred to a medium sheet (paper) and heat fixed.

Another common process is that of direct to paper ink jet printing systems. In ink jet printing, tiny droplets of ink are sprayed onto the paper in a controlled manner to form the image. Other processes are well known to those skilled in the art. The primary output product for a typical digital printing system is a printed copy substrate such as a sheet of paper bearing printed information in a specified format.

The output sheet can be printed on one side only, known as simplex, or on both sides of the sheet, known as duplex printing. In order to duplex print, the sheet is fed through a marking engine to print on the first side, then the sheet is inverted and fed through the marking engine a second time to print on the reverse side. The apparatus that turns the sheet over is called an inverter.

FIG. 1 shows a state-of-the-art inkjet digital printing machine 40. Printer 40 includes a marking module or engine 42 having an ink jet print head or multiple print heads 43, disposed centrally on the marking engine 42, and facing downward. Printer 40 has a media path or process path 44 along which the media sheet 54 moves. Printer 40 has a media path entrance 46 where sheets are fed into the printer by a media sheet feeder (not shown). Printer 40 also has a media path exit 48 where sheets leave the printer and are fed into a finisher (not shown). Printer 40 has an inverter 50 to turn the sheet over for duplex printing. A media sheet 54 leaving the inverter 50 follows arrow 52 back to the marking engine 42 for printing on the reverse side. Arrow 44 indicates the process path direction, which is downstream from entrance 46 toward exit 48. A vacuum transport conveyor 60 moves the media sheet 54 under the print head 43.

FIGS. 2-5 show that in cut sheet printing devices, under certain conditions, the lead-edge of the paper can curl up and have potential for separating from the marking transport and contact the print head. A sheet 54 with out-of-spec flatness can occur when a duplexed sheet has a heavy ink image on the trail edge 58 of side 1, which then becomes the lead edge 56 when inverted and curls towards Side 2. This is most severe when the paper is thin, the aqueous ink coverage is heavy, there is a border bar image near the lead edge, and the cross-process direction image is parallel to the grain direction of the paper (Example: letter size paper, grain-long, long-edge-feed).

In direct-to-paper ink jet marking engines, an ink jet print head 43, or typically multiple ink jet print heads 43, are mounted such that the face (where the ink nozzles are located) of each print head is mounted a fixed distance from the surface of the media 54. The gap is typically 1.5 mm or less. Because the paper curl height can be several millimeters, it poses a risk to the print head because the paper can hit the print head face plate when it passes through the nominally thin gap that the print heads are spaced from the media.

Media sheets 54, typically paper, can curl or distort in several ways. LE curl is a concave upward bending along the process direction, such that the lead edge 56 (LE) and the trail edge 58 (TE) rise up off the transport 60, as shown in FIG. 2. The raised LE can impact multiple print heads across the paper width. Cross curl is a concave upward bending across the process direction, such that the left side and right side edges rise up off the transport, as shown in FIG. 3. The raised sides can impact multiple print heads. Both LE curl and cross curl are caused by ink on the first side of a duplex print that is inverted.

Dog ear is a crease with upward bending across the process direction at an angle across a corner, as shown in FIG. 4. The crease can impact multiple print heads downstream. This is caused by sheet damage in the paper path. Print head damage is severe due to greater pressure.

Cockle is multiple bumps or peaks distributed throughout the sheet, as shown in FIG. 5. The bumps can impact multiple print heads downstream. Cockle is caused by the drying rate of ink, especially aqueous based inks.

For ideal image quality, the print head gap or distance of the print head 43 to the sheet 54 should be maintained at less than 1.2 mm, preferably within 1 mm. The media sheet traveling at one meter per second must pass freely under the print heads. The sheet must not contact the face of the print head, or serious damage will result. This requirement poses a challenge for cut sheet media since the corners, edges and body of the sheet may not be completely flat. The use of a hold down transport such as a vacuum conveyor helps to maintain the sheet flat and within the gap for the most part. Purposely delivering sheets with downward curl from the sheet supply tray also helps to hold the sheet flat. Nevertheless it is not guaranteed that a sheet is flat over the entire surface.

Ink jet print heads are very delicate and can easily be damaged if the face of the print head is contacted by the media which is passing nearby. The print heads are also very expensive. Thus, it is very important to minimize any risk of damaging these print heads.

Accordingly, there is a need to provide a print head protection device for inkjet printers that will prevent print head damage, and also prevent jamming of sheets on the vacuum transport conveyor.

There is a further need to provide a print head protection device for inkjet printers of the type described and that will match the high production rate of a digital printing machine.

There is a yet further need to provide a print head protection device for inkjet printers of the type described and that is mechanically simple and robust, thereby minimizing cost.

SUMMARY

In one aspect, a transport with media hold down is used in connection with an inkjet printer having an inkjet print head. A media sheet has a lead edge and a trail edge, and moves in a process direction along a process path. The transport with media hold down comprises a pair of driven wheels and a pair of drive wheels spaced apart from the driven wheels. A plurality of links connected pivotally together form an endless belt adapted for orbiting around the drive wheels and the driven wheels.

At least one of the plurality of links is a spar link having a spar link surface facing away from the endless belt. The spar link has a spar link slot. The remaining links are vacuum links. Each vacuum link has a hollow chamber communicating with a vacuum source. The vacuum holds the media sheet against the endless belt.

A cam is disposed adjacent the endless belt. A follower is adapted to operatively follow the cam.

At least one spar is movably mounted on the spar link and is received in the spar link slot. The spar is operatively connected to the follower. The spar has a clamp flange. The spar is adapted to move into an extended position above the spar link surface by the cam and follower. In this position, it will receive the media sheet.

The spar is adapted to move into a clamping position by the cam and follower with the media sheet lead edge sandwiched between the clamp flange and the spar link surface. In this position, it will hold the media sheet lead edge clamped against the spar link surface. The media sheet will thus pass beneath the inkjet print head without contacting the inkjet print head.

The spar is adapted to move into the extended position by the cam and follower. In this position, it will release the media sheet.

The spar is adapted to move into a retracted position below the spar link surface by the cam and follower. In this position, it will allow the media sheet to exit the transport.

In another aspect, a transport with media hold down is used in connection with an inkjet printer having an inkjet print head. A media sheet has a lead edge and a trail edge, and moves in a process direction along a process path. The transport with media hold down comprises a frame extending longitudinally in the process direction from a first end to an opposite second end. At least one first axle is mounted on the frame at the first end. A pair of driven wheels is mounted for rotation on the at least one first axle. At least one second axle is mounted on the frame at the second end. A pair of drive wheels is mounted for rotation on the at least one second axle. At least one drive motor operatively drives at least one of the drive wheels.

A plurality of links is operatively connected together. Each link extends between opposite ends transversely to the process direction. Each link has two opposed generally parallel link edges. Each link edge is juxtaposed with an adjacent link edge on each adjacent link. The plurality of links is operatively drivingly attached to the drive wheels. Each link is adapted for pivotal motion with respect to each adjacent link. Each link has a link surface facing outward. The plurality of links is adapted for holding the media sheet generally flat against each link surface and conveying the media sheet in the process direction. At least one of the plurality of links is a spar link. The remaining links are vacuum links.

At least one spar extends between opposite ends juxtaposed with the spar link opposite ends. The spar link has a spar link surface facing outward. The spar link has a slot extending through the spar link surface to receive the spar. The spar is adapted to move into a retracted position below the spar link surface. The spar is also adapted to move into an extended position above the spar link surface.

The spar has a clamp flange. The spar is adapted to move into a clamping position with the media sheet lead edge sandwiched between the clamp flange and the spar link surface. In this position, the spar will hold the media sheet lead edge clamped against the spar link surface. The media sheet will thus pass beneath the inkjet print head without contacting the inkjet print head.

At least one lift cam has an entry portion with an entry profile disposed adjacent the first end. The lift cam has an exit portion with an exit profile disposed adjacent the second end.

At least one lift follower is attached to the at least one spar link. The spar is operatively connected to the lift follower. The lift follower is adapted to follow the lift cam entry profile. The lift follower will move the spar from the retracted position to the extended position to receive the media sheet. The lift follower will then move the spar to the clamping position to clamp the media sheet.

The lift follower is adapted to follow the lift cam exit profile. The lift follower will move the spar from the clamping position to the extended position to release the media sheet from the clamping position. The lift follower will then move the spar to the retracted position. In this position, the media sheet is allowed to exit the transport.

In yet another aspect, a transport with media hold down is used in connection with an inkjet printer having an inkjet print head. A media sheet has a lead edge and a trail edge, and moves in a process direction along a process path. The transport with media hold down comprises a pair of side frames generally parallel and spaced apart. The side frames extend longitudinally in the process direction between opposite first and second ends. The second ends are downstream in the process direction from the first ends. At least one cross frame extends transversely between the side frames. At least one first axle is mounted on the side frames at the first ends. A pair of driven wheels is mounted for rotation on the at least one first axle. At least one second axle is mounted on the side frames at the second ends. A pair of drive wheels is mounted for rotation on the at least one second axle. At least one drive motor operatively drives at least one of the drive wheels.

A plurality of links is provided. Each link extends between opposite ends transversely to the process direction. The opposite ends of each link are disposed adjacent the side frames. Each link has two opposed generally parallel link edges extending transversely to the side frames. Each link edge has serrations interlaced with corresponding serrations along the link edge on each adjacent link. In this manner, the link edges will support the media sheet transversely across the transport.

At least one flexible drive belt is attached to each link of the plurality of links to pivotally connect each link together. The flexible drive belt is adapted to operatively move the plurality of links in an orbital motion around the drive wheels and the driven wheels.

An endless belt is formed by the plurality of links operatively connected together. The endless belt extends partway around the drive wheels and partway around the driven wheels. The endless belt also extends between the drive wheels and the driven wheels. The endless belt is operatively drivingly attached to the drive wheels.

Each link has a link surface facing outward away from the endless belt. The plurality of links is adapted for holding the media sheet generally flat against each link surface and conveying the media sheet in the process direction. At least one of the plurality of links is a spar link. The remaining links are vacuum links.

At least one spar extends between opposite ends. The opposite ends of the spar are juxtaposed with the spar link respective opposite ends. The spar is coextensive with the one of the plurality of links defining the spar link. The spar link has a spar link surface facing outward away from the endless belt. The spar link has a slot extending through the spar link surface to receive the spar. The spar is adapted to move into a retracted position below the spar link surface to allow for paper exit. The spar is also adapted to move into an extended position above the spar link surface to create a stop and clamp for the paper lead edge.

The spar is L-shaped in cross-section uniformly between the spar ends. The spar has a mount flange and a clamp flange, which together form the L-shape. The spar is adapted to move into a clamping position with the media sheet lead edge sandwiched between the clamp flange and the spar link surface. In this position, the spar will hold the media sheet lead edge clamped against the spar link surface. The media sheet will thus pass beneath the inkjet print head without contacting the inkjet print head.

At least one lift cam is provided, typically one on each end of the spar. The lift cam has an entry portion with an entry profile. The lift cam also has an exit portion with an exit profile. A lift track extends between the entry portion and the exit portion. The lift cam lies generally in a plane that is generally parallel to the side frames. The entry portion is juxtaposed with one of the driven wheels. The exit portion is juxtaposed with a corresponding one of the drive wheels.

At least one lift follower is attached to the at least one spar link. The spar is operatively connected to the lift follower. The lift follower is adapted to follow the lift cam entry profile to move the spar from the retracted position to the extended position, where it will receive the media sheet. The lift follower will then move the spar to the clamping position to clamp the media sheet.

The lift follower is adapted to follow the lift track so as to retain the spar in the clamping position during printing. The lift follower is adapted to then follow the lift cam exit profile so as to move the spar from the clamping position to the extended position to release the media sheet from the clamping position. The lift follower will then move the spar to the retracted position, thus allowing the media sheet to exit the transport.

In still another aspect, a method is disclosed for holding a media sheet down on a transport. The method is used in connection with an inkjet printer having an inkjet print head. A media sheet has a lead edge and a trail edge, and moves in a process direction along a process path. The method comprises connecting a plurality of links pivotally together and orbiting the links edgewise around drive wheels and driven wheels. This will form an endless belt defining the transport. The media sheet is transported in the process direction with the endless belt.

A spar is movably mounted on at least one link of the plurality of links. The spar is moved into a clamping position with a cam and follower. The media sheet lead edge is clamped to the at least one link by means of the spar. The media sheet is held generally flat against the endless belt surface with the spar during printing. The spar moves into an extended position with the cam and follower so as to release the media sheet. The spar moves into a retracted position with the cam and follower so as to allow the media sheet to exit the transport.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
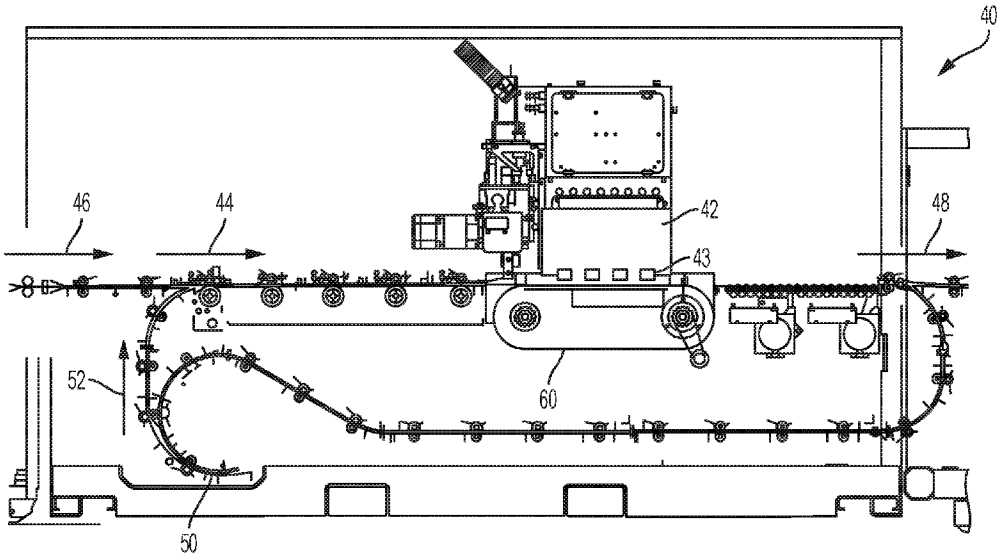
FIG. 1 is a schematic side elevational, sectional view of an exemplary prior art production printer suitable for use with the invention.
Figure 2:
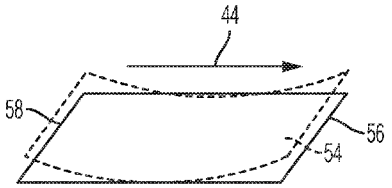
FIG. 2 is a schematic isometric view of a media sheet showing LE curl.
Figure 3:
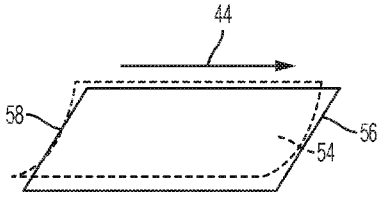
FIG. 3 is a schematic isometric view of a media sheet showing cross curl.
Figure 4:
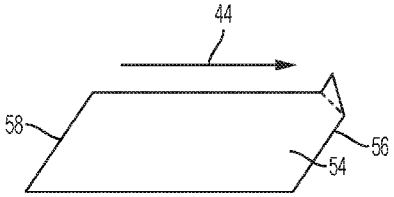
FIG. 4 is a schematic isometric view of a media sheet showing dog ear.
Figure 5:
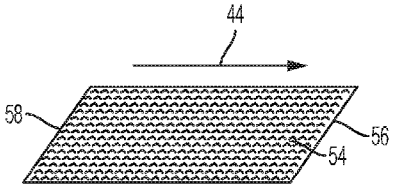
FIG. 5 is a schematic isometric view of a media sheet showing cockle.
Figure 6:
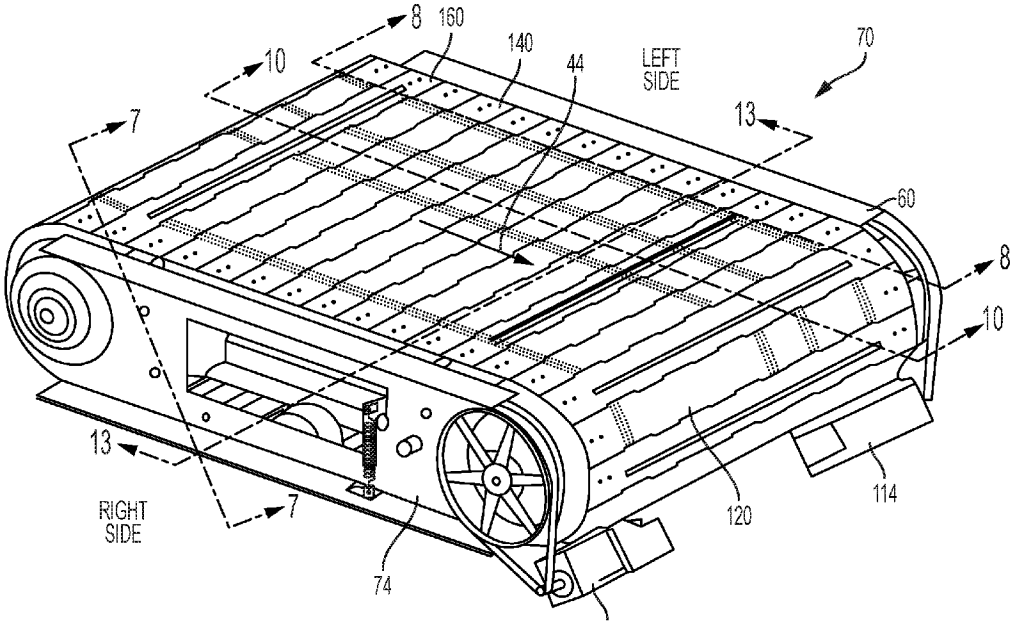
FIG. 6 is a side perspective view of a transport with media hold down constructed in accordance with the invention.
Figure 7:
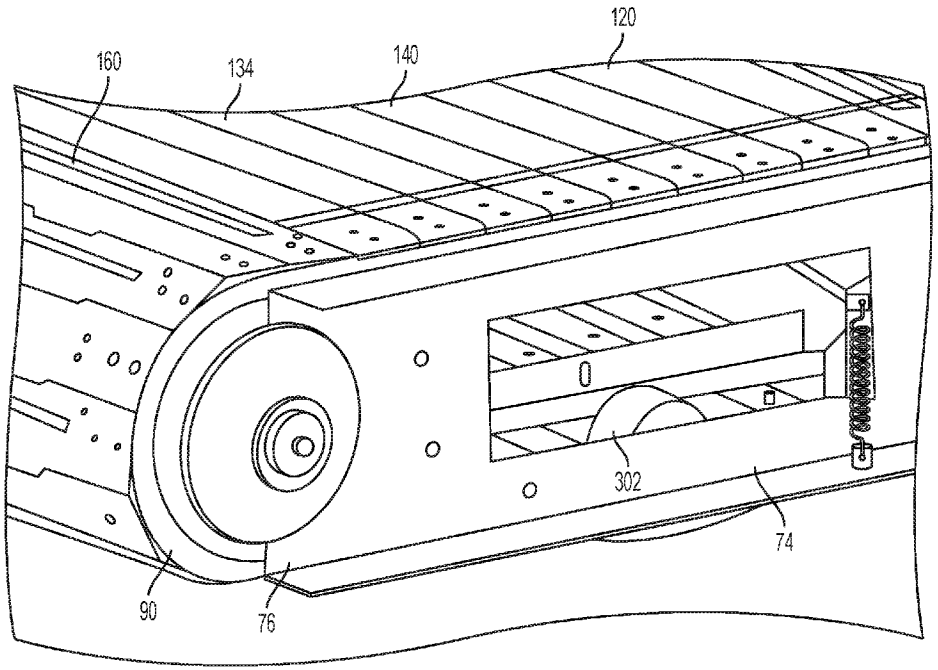
FIG. 7 is an enlarged, detail perspective view of the transport with media hold down of FIG. 6, taken along lines 7-7 of FIG. 6.
Figure 8:
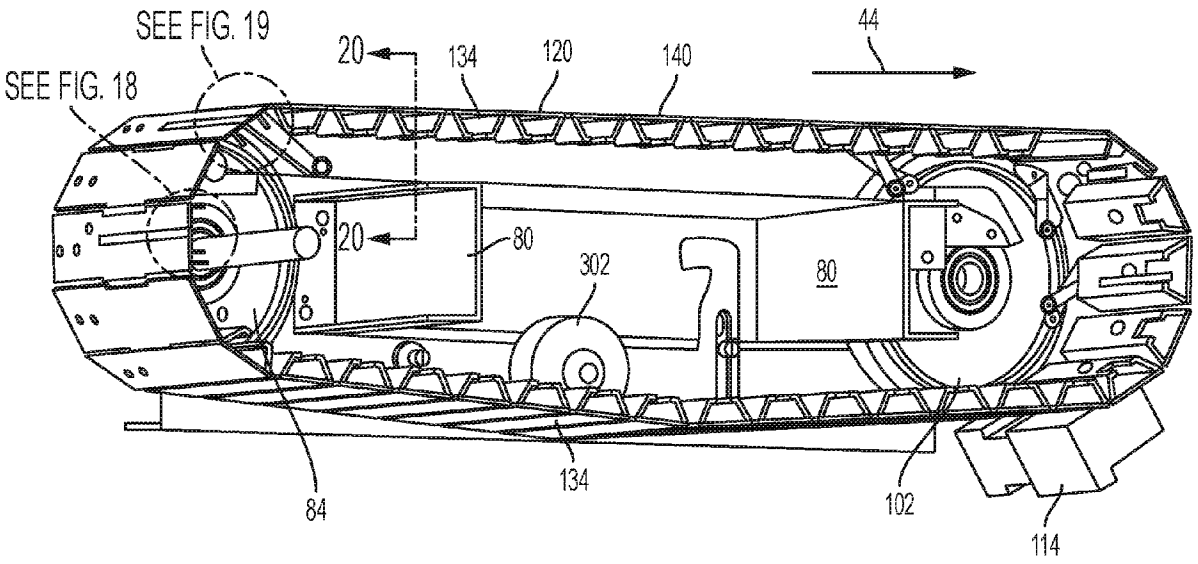
FIG. 8 is a side perspective cross-sectional view of the transport with media hold down of FIG. 6, taken along lines 8-8 of FIG. 6.
Figure 9:
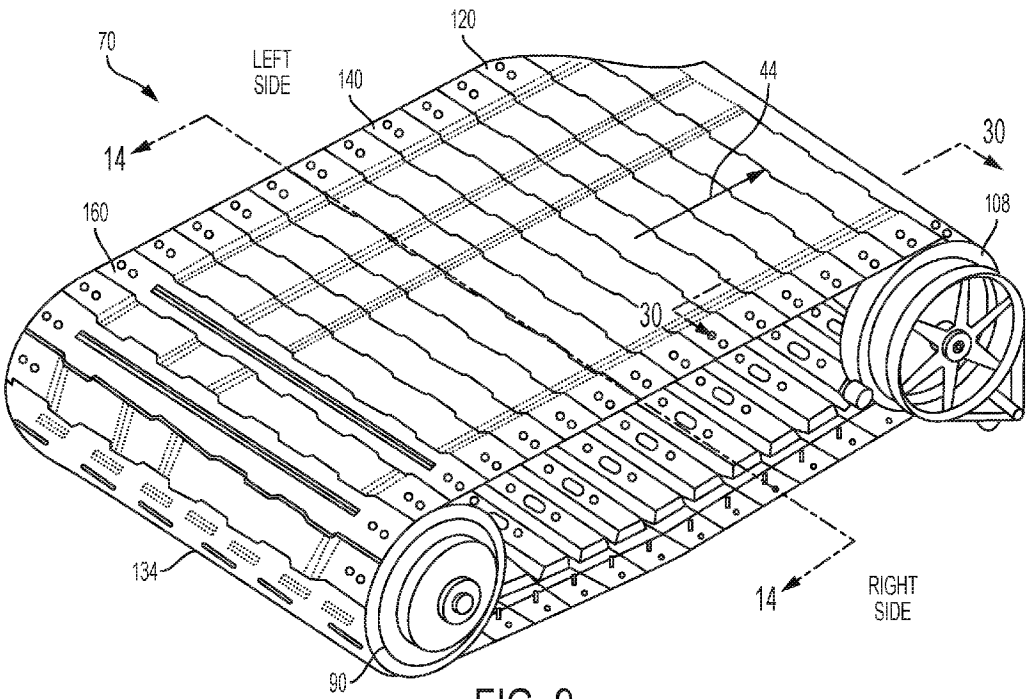
FIG. 9 is another side perspective view of the transport with media hold down of FIG. 6, with the side frame, cross frame, and tensioner removed.
Figure 10:
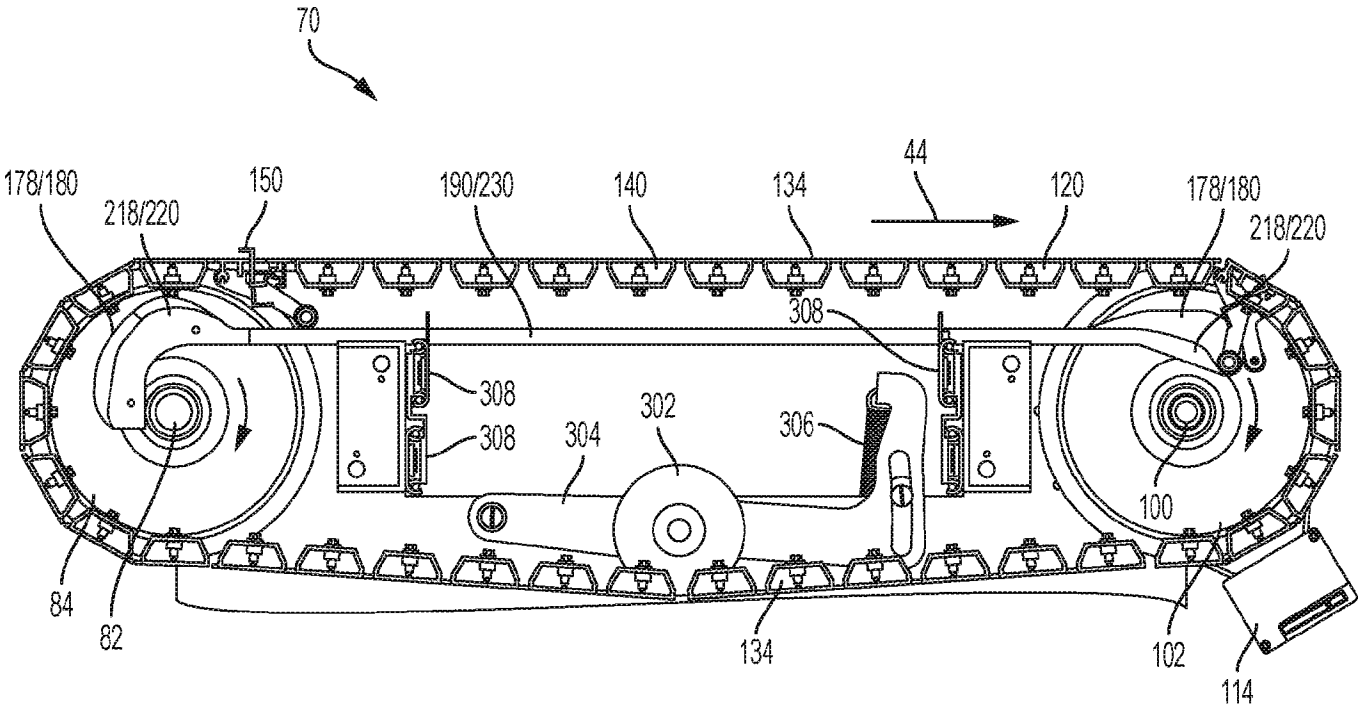
FIG. 10 is a side elevational cross-sectional view of the transport with media hold down of FIG. 6, taken along lines 10-10 of FIG. 6, and showing the hold down mechanism.

Describing now in further detail these exemplary embodiments with reference to the Figures as described above, the system is typically used in a select location or locations of the paper path or paths of various conventional media handling assemblies. Thus, only a portion of an exemplary media handling assembly path is illustrated herein. It should be noted that the drawings herein are not to scale.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" or "media sheet" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" or "lead edge" LE of a media substrate refers to an edge of the sheet that is furthest downstream in the process direction. The "trailing edge" or "trail edge" TE is the upstream edge. LEF means long edge feed, wherein the side (longer of the two edges) of the letter moves in the process direction. SEF means short edge feed, wherein the end (shorter of the two edges) of the letter moves downstream. Sheet to sheet pitch is the distance between consecutive media sheets.

As used herein, a "media handling assembly" refers to one or more devices used for handling and/or transporting media substrate, including feeding, printing, finishing, registration and transport systems. A media transport is a hold-down and conveying apparatus for moving the media along the process path. The media transport in the print zone or image transfer zone is instrumental in holding the media flat as it passes under the print heads. The media transport often utilizes a belt operating over a platen. To aid in holding the media flat either a vacuum or an electrostatic field is employed, sometimes both in combination.

As used herein, the terms "process" and "process direction" refer to a procedure of moving, transporting and/or handling a substrate media sheet. The process direction is a flow path the sheet moves in during the process. The left and right sides of the transport are defined looking downstream in the process direction.

Referring now to the drawings, a transport with media hold down 70 is used in connection with an inkjet printer 40 having an inkjet print head 43. A media sheet 54 has a lead edge 56 and a trail edge 58, and moves in a process direction 44 along a process path 44. The transport with media hold down 70 comprises a pair of side frames, including a left side frame 72 and a right side frame 74 generally parallel and spaced apart. The side frames 72, 74 extend longitudinally in the process direction 44 between opposite first 76 and second 78 ends. The second ends 78 are downstream in the process direction from the first ends 76. At least one cross frame 80 extends transversely between the side frames 72, 74. Typically, two cross frames 80 will be used.

At least one first axle 82 is mounted on the side frames 72, 74 at the first ends 76. A pair of driven wheels includes a left driven wheel 84 and a right driven wheel 90. The left and right driven wheels 84, 90 are mounted for rotation on the first axle 82. The left 84 and right 90 driven wheels each has an outer rim with a circumference. The left driven wheel 84 has an outer rim 86. The right driven wheel 90 has an outer rim 92. The left 84 and right 90 driven wheels each has an inner rim with a circumference. The left driven wheel 84 has an inner rim 88. The right driven wheel 90 has an inner rim 94. In each case, the inner rim is smaller in diameter than the outer rim. In each case, a shoulder extends between the outer rim and the inner rim. The left driven wheel 84 has a shoulder 87. The right driven wheel 90 has a shoulder 93.

At least one second axle 100 is mounted on the side frames 72, 74 at the second ends 78. Typically, two second axles 100 are employed, one on each of the side frames 72, 74. A pair of drive wheels includes a left drive wheel 102 and a right drive wheel 108. Each drive wheel 102, 108, is drivingly attached to one of the second axles 100. The left 102 and right 108 drive wheels are mounted for rotation on the second axles 100. The left 102 and right 108 drive wheels each has an outer rim with a circumference. The left drive wheel 102 has an outer rim 104. The right drive wheel 108 has an outer rim 110. The left 102 and right 108 drive wheels each has an inner rim with a circumference. The left drive wheel 102 has an inner rim 106. The right drive wheel 108 has an inner rim 112. In each case, the inner rim is smaller in diameter than the outer rim. In each case, a shoulder extends between the outer rim and the inner rim. The left drive wheel 102 has a shoulder 105. The right drive wheel 108 has a shoulder 111.

Each drive wheel outer rim 104 and 110 has a plurality of teeth 96 projecting radially outward from the rim surface. The teeth 96 are spaced uniformly apart around the outer rim circumference.

The left driven wheel 84 is aligned with the left drive wheel 102 in the process direction. The right driven wheel 90 is aligned with the right drive wheel 108 in the process direction. At least one drive motor 114 operatively drives at least one of the drive wheels. Typically, two drive motors 114 with drive belts are utilized, each motor operatively driving one of the drive wheels 102, 108.

A plurality of links 120 is provided. At least one of the plurality of links 120 is a spar link 160 and holds the media sheet LE 56 down, as will be explained below. The remaining links are vacuum links 140, which also hold the media sheet down, using vacuum. Typically, multiple spar links 160 are employed. The spar links 160 are spaced apart according to the sheet to sheet pitch. The sheet pitch is fixed for a particular printer, and would need to accommodate the largest sheet process length. The links in between adjacent spar links 160 are vacuum links 140. The links are preferably made of aluminum.

An endless belt 134 is formed by the plurality of links 120 operatively connected together. The endless belt 134 extends partway around the drive wheels 102, 108, and partway around the driven wheels 84, 90. The endless belt 134 also extends between the drive wheels and the driven wheels. The endless belt 134 is operatively drivingly attached to the drive wheels 102, 108. The endless belt 134 comprises the transport 70 that supports and conveys the media sheet 54 along the process path 44. A pair of idler wheels 302, one on each side of the frame, presses downward to tension the endless belt 134. The idler wheels 302 are mounted on pivot arms 304 and biased by springs 306.

Each link 120 extends between opposite ends transversely to the process direction. Each link 120 has a left end 122 disposed adjacent the left side frame 72 and an opposite right end 124 disposed adjacent the right side frame 74. Each link 120 has a link surface 136 facing outward away from the endless belt 134.

Each link 120 has two opposed generally parallel link edges 126 extending transversely to the side frames 72, 74. Each link edge 126 has serrations 128 interlaced with corresponding serrations 128 along the link edge 126 on each adjacent link 120. In this manner, the link edges 126 will support the media sheet 54 transversely across the transport 70. The serrations 128 prevent the media sheet 54 from being drawn downward in between links 120 due to the vacuum. In the embodiment shown, the serrations 128 do not form a hinge. However, the serrations 128 can be rolled to form a knuckle, and a hinge pin (not shown) inserted to form a piano hinge structure. The drawings, description, and claims herein disclose the best mode for carrying out the invention, and are non-limiting.

Each link 120 has a left drive hole 130 adjacent the left end 122 and a right drive hole 132 adjacent the right end 124. The left drive hole 130 is adapted to receive and release one of the left drive wheel teeth 96. The right drive hole 132 is adapted to receive and release one of the right drive wheel teeth 96. In this manner, the drive wheel teeth 96 will operatively engage and drive the links 120, causing the endless belt 134 to orbit the drive wheels 102, 108, and the driven wheels 84, 90.

The plurality of links 120 includes a plurality of vacuum links 140. Each vacuum link 140 has a left tracking pin 98 adjacent the left end 122 and a right tracking pin 99 adjacent the right end 124. The left tracking pin 98 is adapted to ride on the inner rim 106 and against the shoulder 105 of the left drive wheel 102. The left tracking pin 98 also rides on the inner rim 88 and against the shoulder 87 of the left driven wheel 84. The right tracking pin 99 is adapted to ride on the inner rim 112 and against the shoulder 111 of the right drive wheel 108. The right tracking pin 99 also rides on the inner rim 94 and against the shoulder 93 of the right driven wheel 90. The left tracking pin 98 and right tracking pin 99 serve to retain the endless belt 134 tracking generally centered on the transport 70. The tracking pins 98, 99, prevent the endless belt 134 from running off the wheels to the left or right side.

Figure 12:
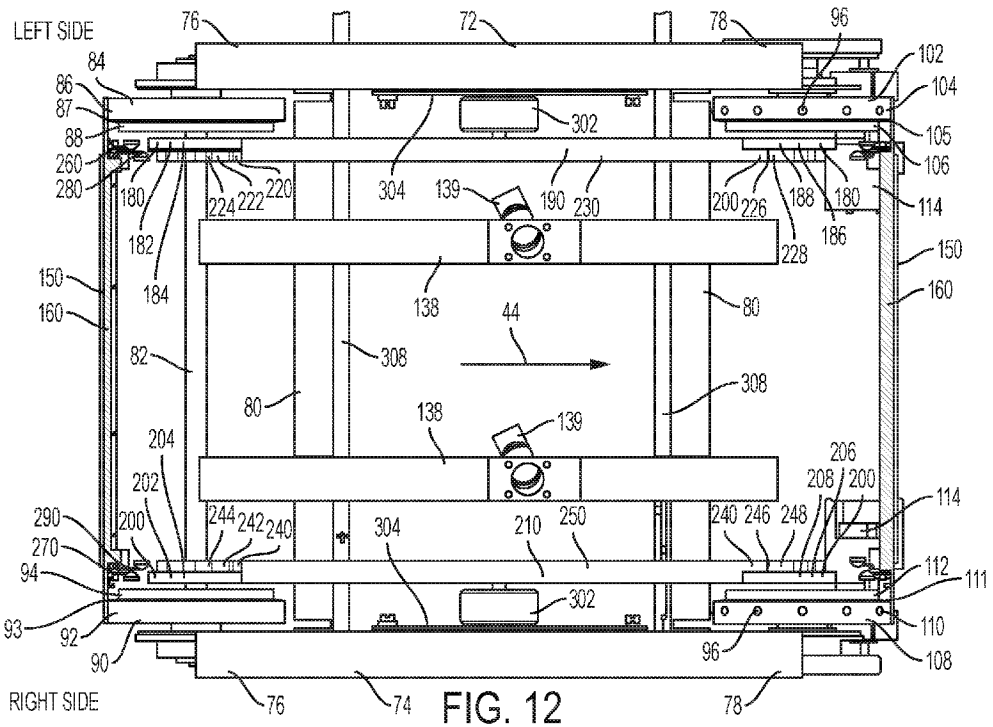
FIG. 12 is a top, plan, cross-sectional view of the transport with media hold down of FIG. 6, taken along lines 12-12 of FIG. 11, and showing the transport with the endless belt removed and showing the vacuum rails.

A vacuum plenum 138 is disposed beneath the endless belt 134. A vacuum source 139 communicates with the vacuum plenum 138 to supply vacuum. Typically, two vacuum plenums 138 are disposed beneath the endless belt 134, as shown in FIG. 12. The vacuum holds the media sheet 54 down against the transport 70. The two vacuum plenums 138 also serve to support the endless belt 134 and keep it flat. No platen or supporting plate is needed, as with the prior art. The vacuum plenums 138 are preferably, but non-limitingly, made of acetal or HDPE.

Figure 11:
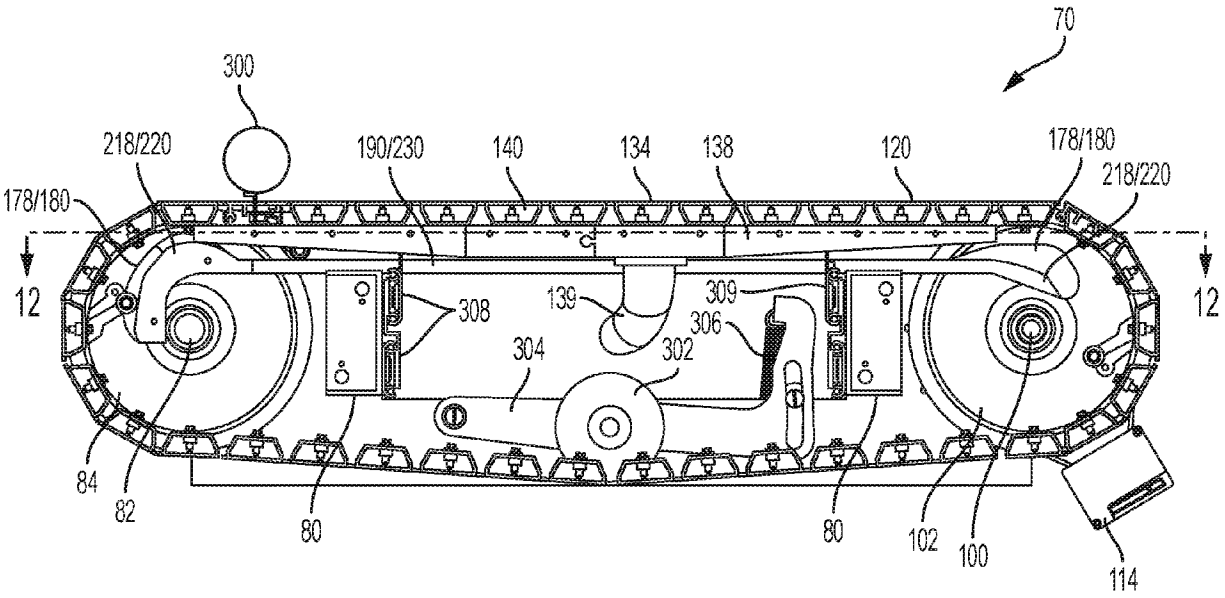
FIG. 11 is a side elevational cross-sectional view of the transport with media hold down of FIG. 6, taken along lines 10-10 of FIG. 6, and showing the vacuum plenum.
Figure 13:
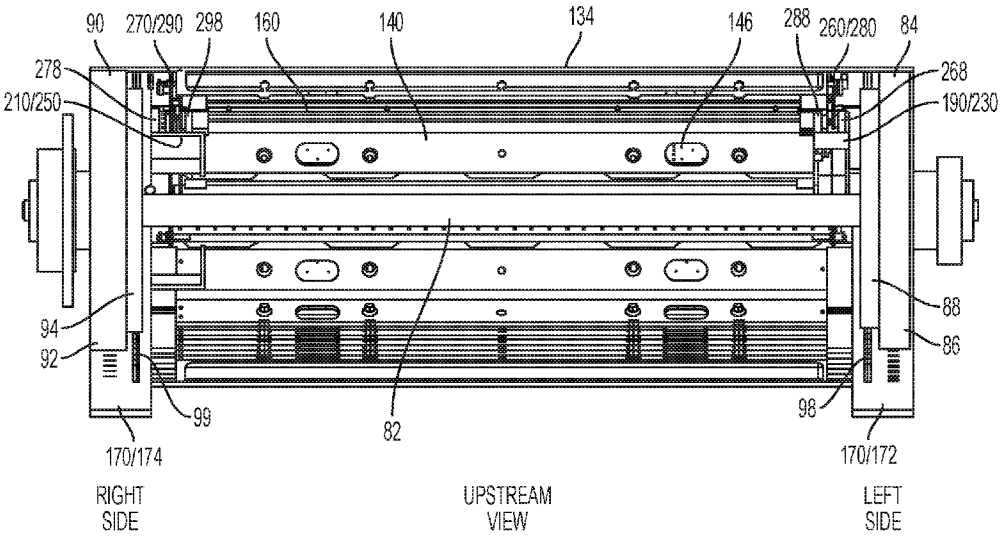
FIG. 13 is a side elevational cross-sectional view of the transport with media hold down of FIG. 6, taken along lines 13-13 of FIG. 6, and showing the upstream driven axle and wheels, and with the side frame, cross frame, and tensioner removed.
Figure 14:
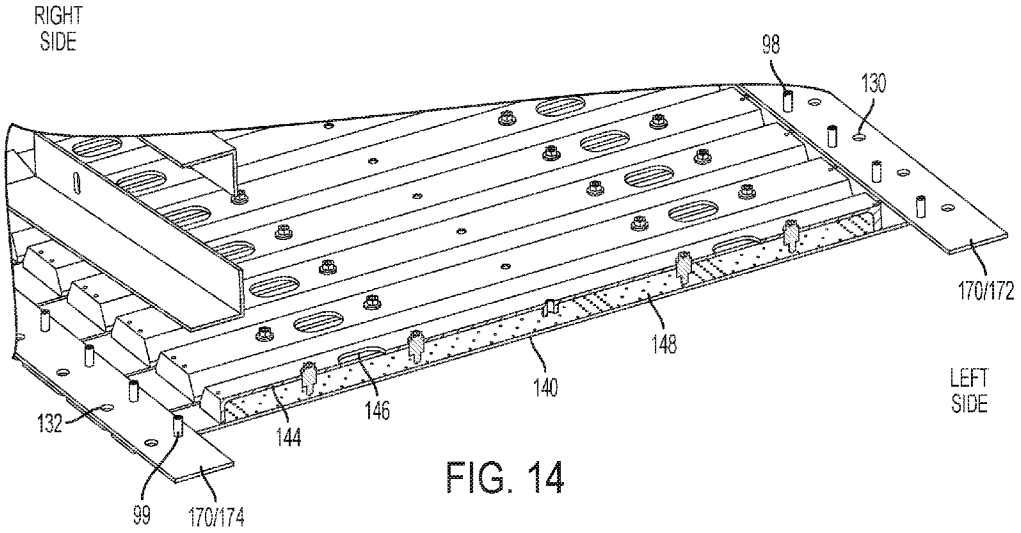
FIG. 14 is a side elevational cross-sectional view of the transport with media hold down of FIG. 6, taken along lines 14-14 of FIG. 9, and showing the vacuum links.
Figure 15:
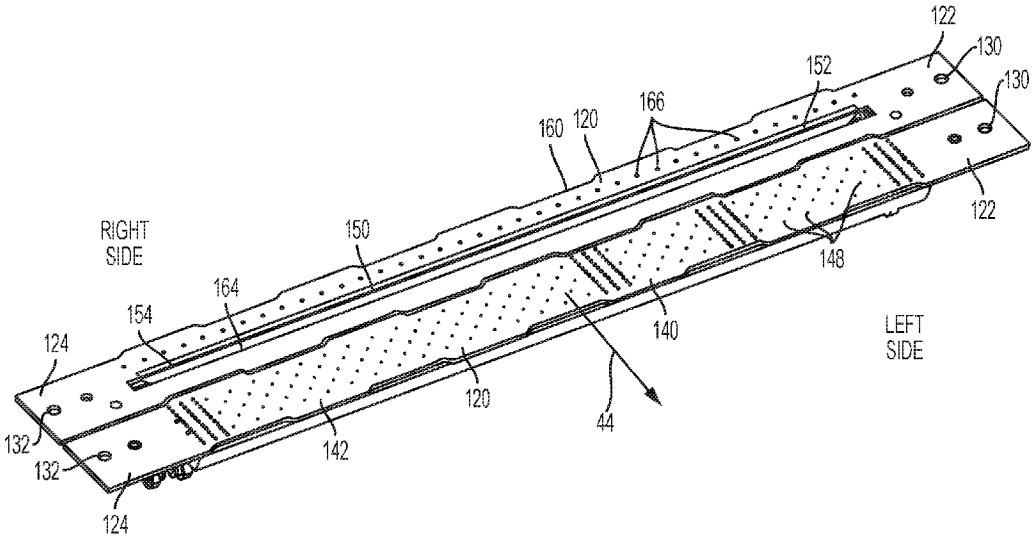
FIG. 15 is a top perspective view of a vacuum link and a spar link.
Figure 16:
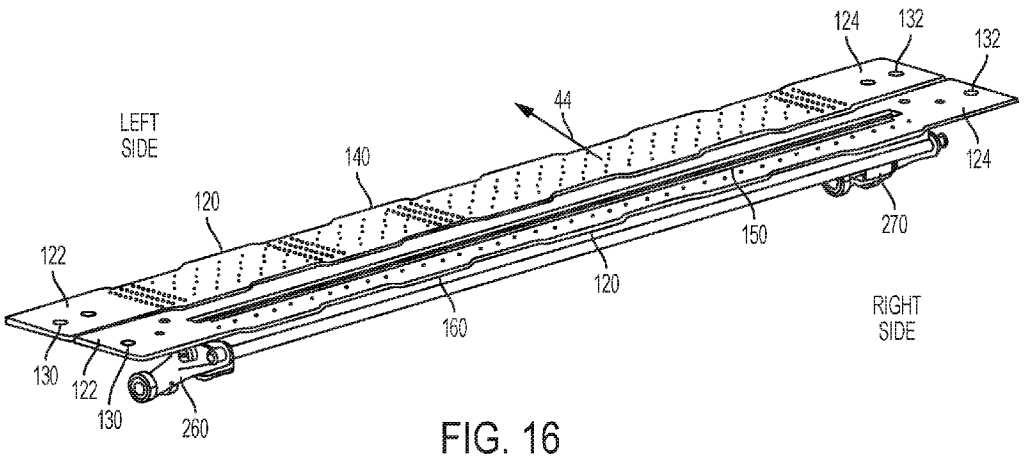
FIG. 16 is another top perspective view of the vacuum link and the spar link, showing the followers.
Figure 17:
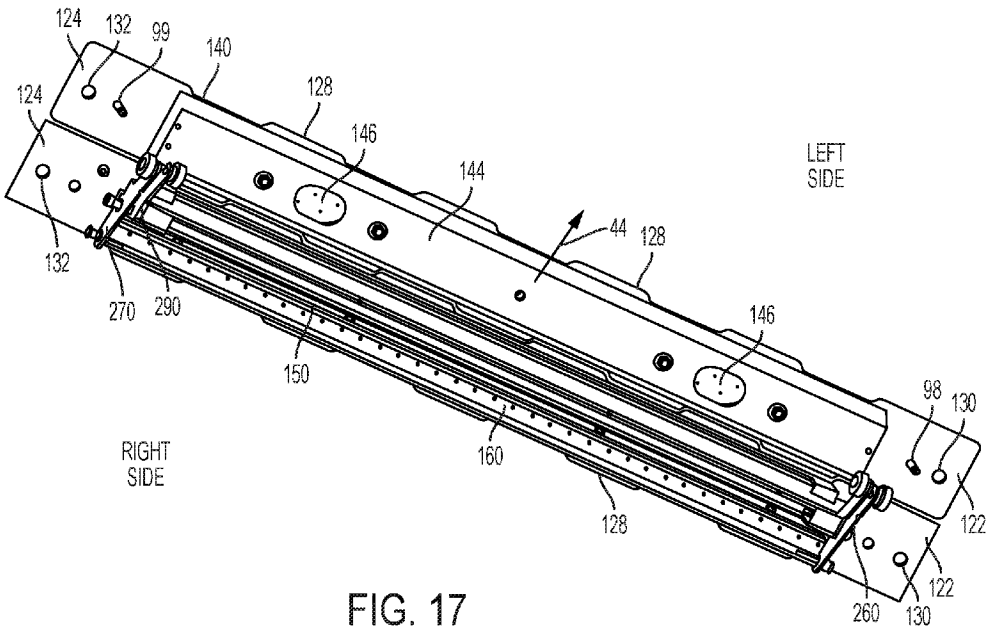
FIG. 17 is a bottom perspective view of the vacuum link and the spar link, showing the spar and followers.

The vacuum links 140 each include a vacuum link surface 142 facing outward away from the endless belt 134. The vacuum links 140 each include a hollow chamber 144 attached to the link below the vacuum link surface 142. The hollow chamber 144 attached to the vacuum link 140 together form a tube that can resist torsion, and thus hold flatness across the length and width of the vacuum link surface 142. The hollow chamber 144 is disposed above the vacuum plenum 138, as shown in FIG. 11. The hollow chamber 144 has at least one aperture 146 through the chamber communicating with the vacuum plenum 138. As shown in FIGS. 12, 13, and 16, the hollow chamber 144 has two oval apertures 146. One oval aperture 146 is aligned with each of the two vacuum plenums 138 beneath the endless belt 134. The vacuum plenums 138 are open along the top, to communicate the vacuum to the oval apertures 146. The vacuum link surface 142 has a plurality of holes 148 through the surface communicating with the hollow chamber 144. The holes 148 are approximately 1.5 mm dia.×25 mm pitch. Thus, the vacuum is applied to the media sheet 54 for holding the media sheet 54 generally flat against the vacuum link surface 142 as the links 120 move over the vacuum plenum 138 in the process direction 44. Preferably, at least −0.1 inch water pressure vacuum is applied to hold the media sheet 54 down. The vacuum link surface 142 has a smoothness of about 32 μinch finish to help spread the vacuum across the area beneath the media sheet 54.

At least one spar 150 is coextensive with the one of the plurality of links 120 defining the spar link 160. Typically, multiple spar links 160 are provided, each spar link 160 having one spar 150. The opposite ends of the spar 150 are juxtaposed with the spar link 160 respective opposite ends. The spar 150 extends between a spar left end 152 disposed adjacent the spar link left end 122 and an opposite spar right end 154 disposed adjacent the spar link right end 124. The spar link 160 has a spar link surface 162 facing outward away from the endless belt 134. The spar link 160 has a slot 164 extending through the spar link surface 162 to receive the spar 150. The spar 150 is adapted to move into a retracted position below the spar link surface 162. The spar 150 is also adapted to move into an extended position above the spar link surface 162.

The spar 150 is L-shaped in cross-section uniformly between the spar ends 152, 154. The spar 150 has a mount flange 156 and a clamp flange 158, which together form the L-shape. The spar mount flange 156 extends between the spar left end 152 and the spar right end 154. The spar clamp flange 158 extends between the spar left end 152 and the spar right end 154. The spar clamp flange 158 is disposed at generally a right angle to the spar mount flange 156.

The spar 150 is adapted to move into a clamping position with the media sheet lead edge 56 sandwiched between the clamp flange 158 and the spar link surface 162. In this position, the spar 150 will hold the media sheet lead edge 56 clamped against the spar link surface 162. The media sheet 54 will thus pass beneath the inkjet print head 43 without contacting the inkjet print head 43. Bleed holes 166 allow trapped air to escape.

At least one flexible drive belt 170 is attached to each link 120 of the plurality of links to pivotally connect each link 120 together. Typically two flexible drive belts 172, 174, are employed. A left flexible drive belt 172 is attached to each link 120 adjacent the left end 122. A right flexible drive belt 174 is attached to each link 120 adjacent the right end 124. Each flexible drive belt 172, 174 has a plurality of drive holes 176 that align with the link drive holes 130, 132. In this manner, the drive wheel teeth 96 will operatively engage and drive the drive belts 172, 174, as well as the links 120. The left 172 and right 174 flexible drive belts pivotally connect each link 120 together and operatively move each link 120 in the process direction. The drive belts 172, 174 are each preferably comprised of a Kevlar® timing belt or a stainless steel flat belt. The material is non-limiting, as any flexible material having low stretch and a high fatigue life can be employed.

At least one lift cam 178 is provided, and typically two lift cams are utilized. A left lift cam 180 has an entry portion 182 with an entry profile 184, and an exit portion 186 with an exit profile 188. The entry profile 184 defines the shape of the entry portion 182. The exit profile 188 defines the shape of the exit portion 186. The left lift cam 180 lies generally in a plane generally parallel to the left side frame 72. The left lift cam 180 lies inboard of the left side frame 72 and the left driven 84 and drive 102 wheels. The left lift cam entry portion 182 is juxtaposed with the left driven wheel 84. The left lift cam exit portion 186 is juxtaposed with the left drive wheel 102.

A left lift track 190 extends between the left lift cam entry portion 182 and the left lift cam exit portion 186. The left lift track 190 is straight and joins the left lift cam entry and exit portions.

A right lift cam 200 has an entry portion 202 with an entry profile 204, and an exit portion 206 with an exit profile 208. The entry profile 204 defines the shape of the entry portion 202. The exit profile 208 defines the shape of the exit portion 206. The right lift cam 200 lies generally in a plane generally parallel to left lift cam 180. The right lift cam 200 lies inboard of the right side frame 74 and the right driven 90 and drive 108 wheels. The right lift cam entry portion 202 is juxtaposed with the right driven wheel 90. The right lift cam exit portion 206 is juxtaposed with the right drive wheel 108. The right lift cam 200 is similar and opposite-hand to the left lift cam 180.

A right lift track 210 extends between the right lift cam entry portion 202 and the right lift cam exit portion 206. The right lift track 210 is straight and joins the right lift cam entry and exit portions.

At least one tilt cam 218 is provided, and typically two tilt cams are utilized. A left tilt cam 220 has an entry portion 222 with an entry profile 224, and an exit portion 226 with an exit profile 228. The entry profile 224 defines the shape of the entry portion 222. The exit profile 228 defines the shape of the exit portion 226. The left tilt cam 220 lies generally in a plane generally parallel to the left lift cam 180. The left tilt cam entry portion 222 is juxtaposed with the left lift cam entry portion 182. The left tilt cam exit portion 226 is juxtaposed with the left lift cam exit portion 186. The left tilt cam 220 is disposed against the left lift cam 180 and inboard of the left lift cam 180, as shown in FIG. 12.

The function of the combined lift and tilt motion at the entry portions 202, 222 is to raise the spar 150 to a maximum height to catch the sheet 54 from the registration system. The sheet 54 will stop against the spar 150 with a slight buckle registration in the process direction 44 to ensure the correct and full clamp of the lead edge 56 of the sheet 54.

The function of the combined lift and tilt cams at the exit portions 186, 226, is opposite to that of the entry. The spar 150 first lifts away from the lead edge 56. The spar 150 then rotates and tucks or retracts down into the slot 164 to eliminate a catch point as the sheet 54 exits the transport 70

A left tilt track 230 extends between the left tilt cam entry portion 222 and the left tilt cam exit portion 226. The left tilt track 230 is straight and joins the left tilt cam entry and exit portions.

A right tilt cam 240 has an entry portion 242 with an entry profile 244, and an exit portion 246 with an exit profile 248. The entry profile 244 defines the shape of the entry portion 242. The exit profile 248 defines the shape of the exit portion 246. The right tilt cam 240 lies generally in a plane generally parallel to the right lift cam 200. The right tilt cam entry portion 242 is juxtaposed with the right lift cam entry portion 202. The right tilt cam exit portion 246 is juxtaposed with the right lift cam exit portion 206. The right tilt cam 240 is disposed against the right lift cam 200 and inboard of the right lift cam 200, as shown in FIG. 12. The right tilt cam 240 is similar and opposite-hand to the left tilt cam 220.

A right tilt track 250 extends between the right tilt cam entry portion 242 and the right tilt cam exit portion 246. The right tilt track 250 is straight and joins the right tilt cam entry and exit portions.

At least one lift follower is attached to the at least one spar link 160. Typically, multiple spar links 160 are provided, as described above. Each spar link 160 has two lift followers. A left lift follower 260 is pivotally attached to the spar link left end 122. The spar left end 152 is operatively connected to the left lift follower 260. In this embodiment, the spar left end 152 is not directly mounted on the left lift follower 260, but can be as an option. The spar mounting disclosed is non-limiting. The left lift follower 260 has two components, a lever and a roller. A left lift lever 262 proximal end 264 is pivotally mounted on the spar link left end 122. The left lift lever 262 distal end 266 has a left lift roller 268 mounted for rotation. The left lift roller 268 is in contact with the left lift cam entry portion 182, and the left lift track 190, and the left lift cam exit portion 186.

A right lift follower 270 is pivotally attached to the spar link right end 124. The spar right end 154 is operatively connected to the right lift follower 270. In this embodiment, the spar right end 154 is not directly mounted on the right lift follower 270, but can be as an option. The spar mounting disclosed is non-limiting. The right lift follower 270 has two components, a lever and a roller. A right lift lever 272 proximal end 274 is pivotally mounted on the spar link right end 124. The right lift lever 272 distal end 276 has a right lift roller 278 mounted for rotation. The right lift roller 278 is in contact with the right lift cam entry portion 202, and the right lift track 210, and the right lift cam exit portion 206.

Figure 18:
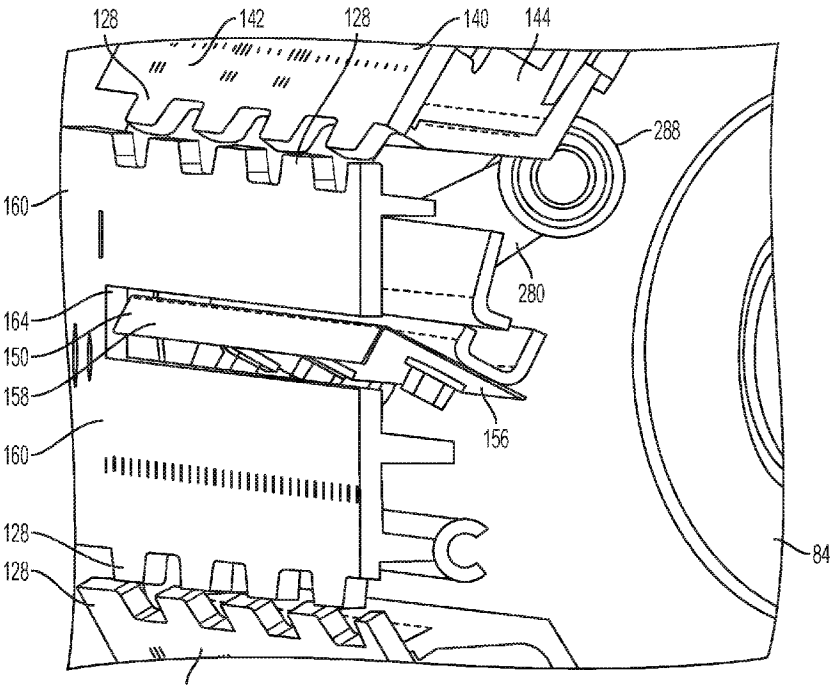
FIG. 18 is a side perspective detail view of the spar link adjacent the driven wheel, taken at detail 18 of FIG. 8, and showing the spar link in the retracted position.
Figure 19:
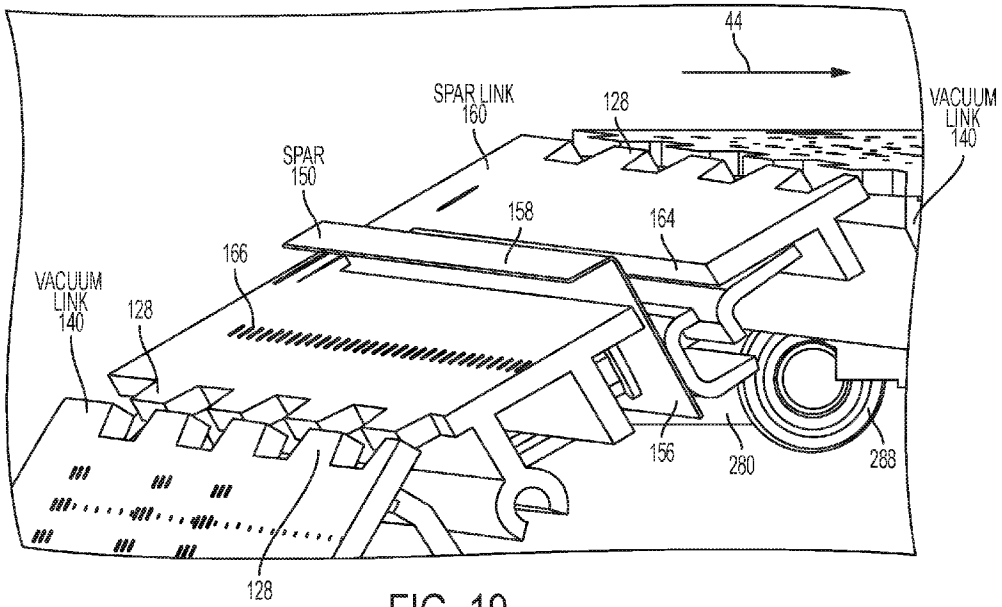
FIG. 19 is another side perspective detail view of the spar link adjacent the driven wheel, taken at detail 19 of FIG. 8, and showing the spar link in the extended position.
Figure 20:
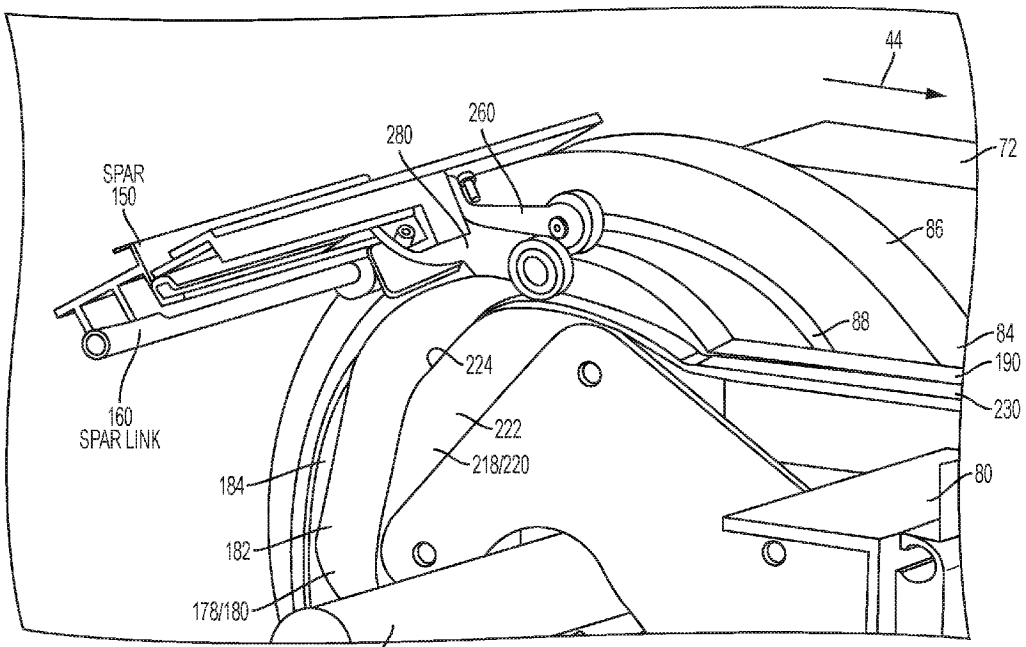
FIG. 20 is yet another side perspective detail view of the spar link adjacent the left driven wheel, taken at view 20-20 of FIG. 8, and showing the spar link in the extended position, and the followers on the left entry cam.
Figure 21:
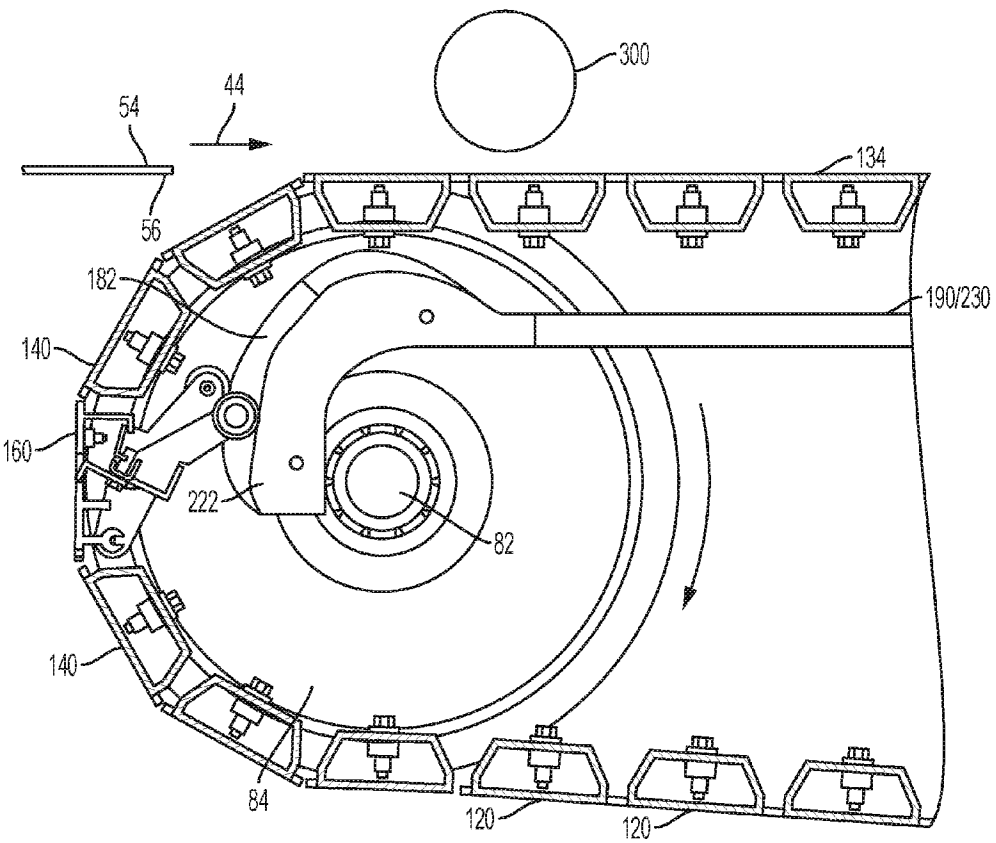
FIG. 21 is a side elevational detail cross-sectional view of the transport with media hold down of FIG. 6, taken along lines 10-10 of FIG. 6, and showing the left driven wheel, the left entry cams, and the spar in the retracted position.
Figure 22:
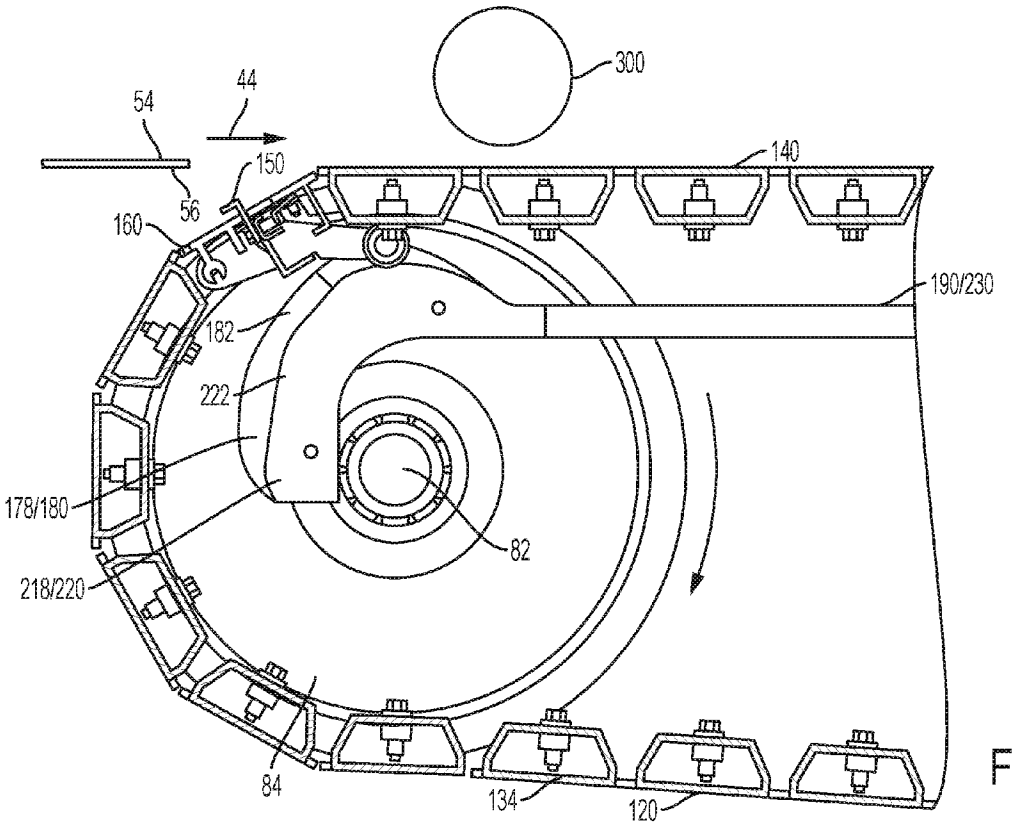
FIG. 22 is a side elevational detail cross-sectional view of the transport with media hold down of FIG. 6, taken along lines 10-10 of FIG. 6, and showing the left driven wheel, the left entry cams, and the spar in the extended position.
Figure 23:
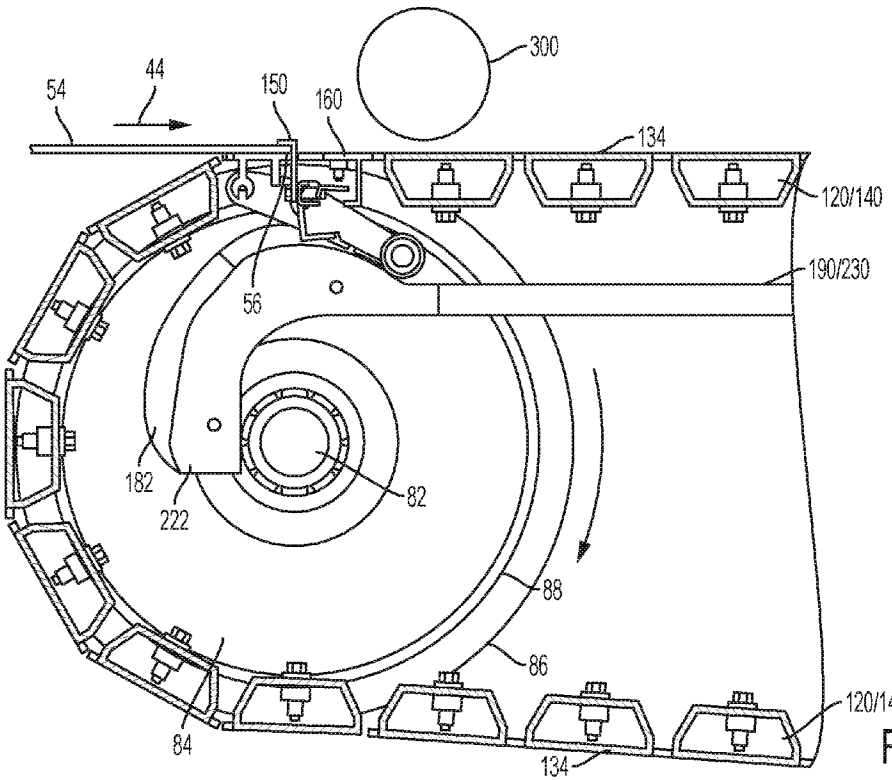
FIG. 23 is a side elevational detail cross-sectional view of the transport with media hold down of FIG. 6, taken along lines 10-10 of FIG. 6, and showing the left driven wheel, the left entry cams, and the spar in the clamping position.
Figure 24:
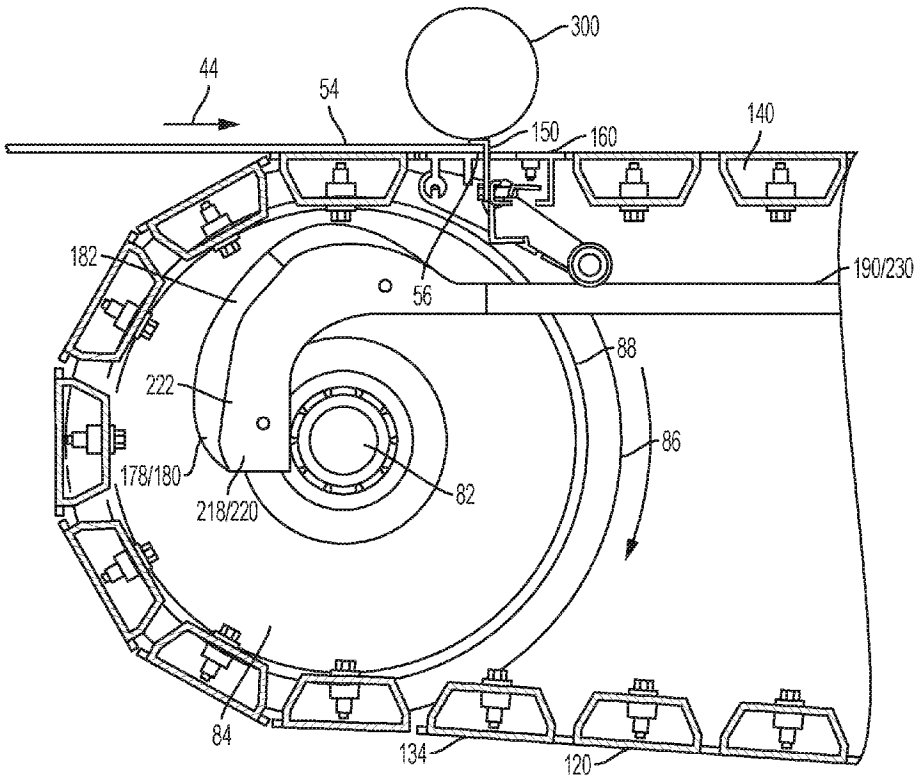
FIG. 24 is a side elevational detail cross-sectional view of the transport with media hold down of FIG. 6, taken along lines 10-10 of FIG. 6, and showing the left driven wheel, the left entry cams, and the spar in the clamping position advancing in the process direction.

The right 270 and left 260 lift followers are adapted to follow the right 204 and left 224 lift cam entry profiles respectively. The lift followers 260, 270 move the spar 150 from the retracted position shown in FIGS. 18 and 21, to the extended position shown in FIGS. 19, 20, and 22, wherein the spar 150 is ready to receive the media sheet 54 lead edge 56. The lift followers 260, 270 then move the spar 150 to the clamping position shown in FIGS. 23 and 24, to clamp the media sheet 54 down against the spar link 160. An optional nip roller 300 with a foam roll covering will flatten the media sheet 54 prior to clamping and prior to passing over the vacuum plenum 138. This roller ensures good flatness to the vacuum slats.

The right 270 and left 260 lift followers are adapted to then follow the right 210 and left 190 lift tracks respectively. The lift tracks are straight, and thus will allow the lift followers 260, 270 to retain the spar 150 in the clamping position during printing. This holds the media sheet 54 down in order to pass beneath the inkjet print head 43 without contacting the inkjet print head 43.

Figure 25:
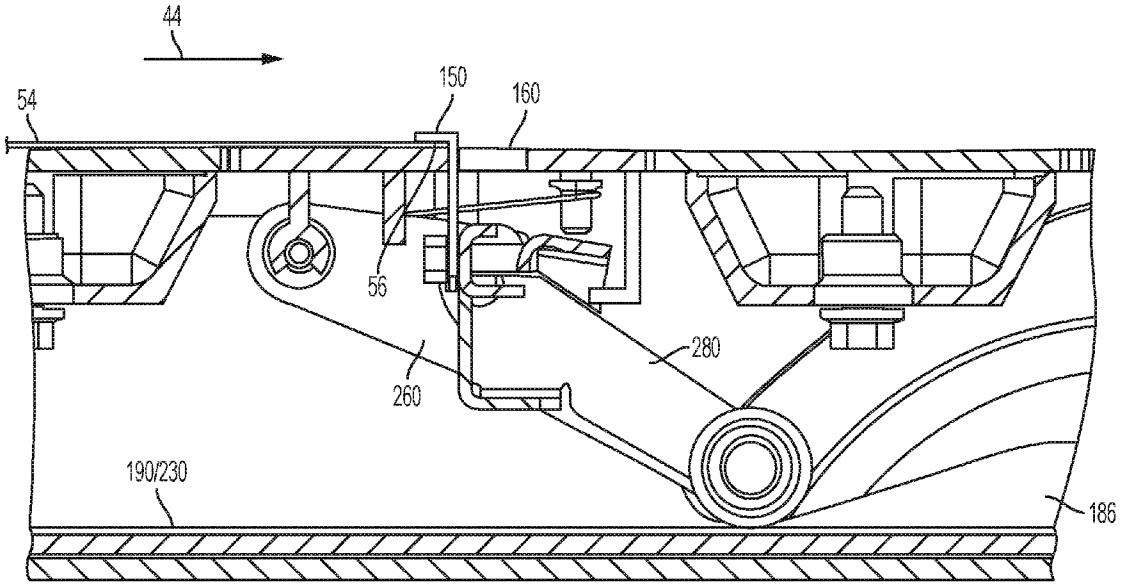
FIG. 25 is a side elevational detail cross-sectional view of the transport with media hold down of FIG. 6, taken along lines 10-10 of FIG. 6, and showing the left drive wheel, the left exit cams, and the spar in the clamping position.
Figure 26:
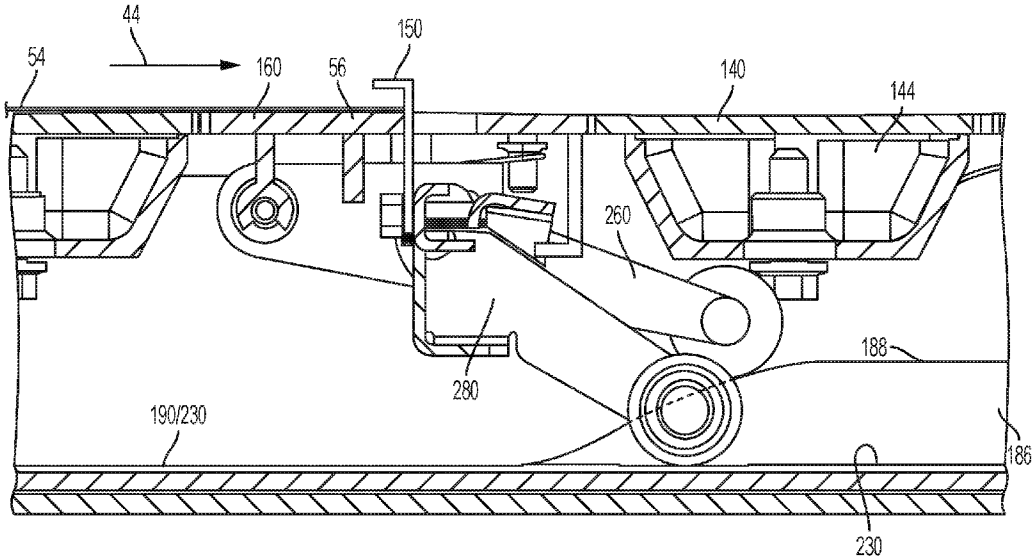
FIG. 26 is a side elevational detail cross-sectional view of the transport with media hold down of FIG. 6, taken along lines 10-10 of FIG. 6, and showing the left exit cams, and the spar in the extended position.
Figure 28:
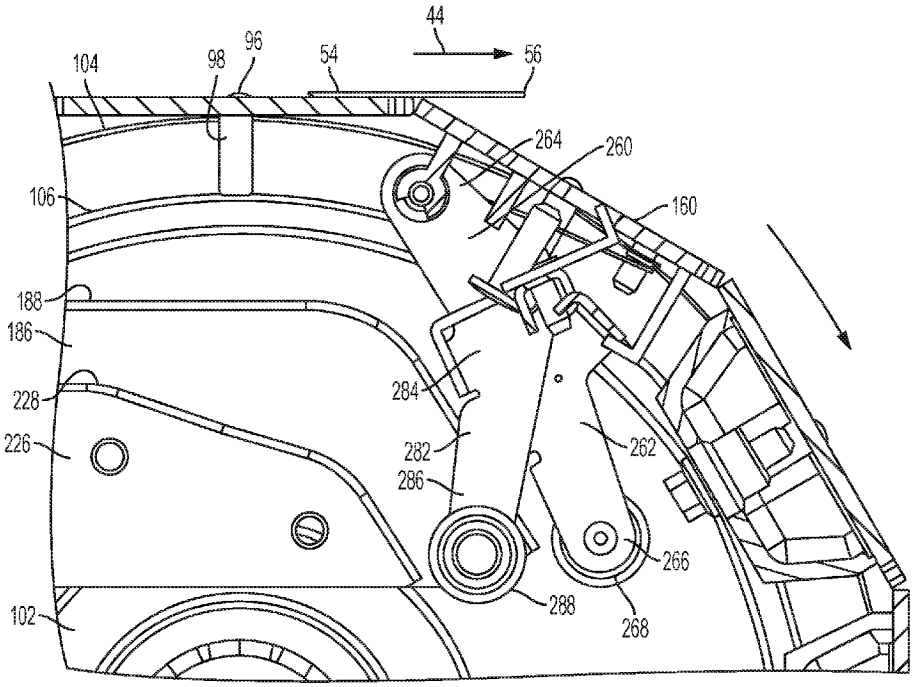
FIG. 28 is a side elevational detail cross-sectional view of the transport with media hold down of FIG. 6, taken along lines 10-10 of FIG. 6, and showing the left drive wheel, the left exit cams, and the spar in the retracted position to allow the paper to exit.
Figure 29:
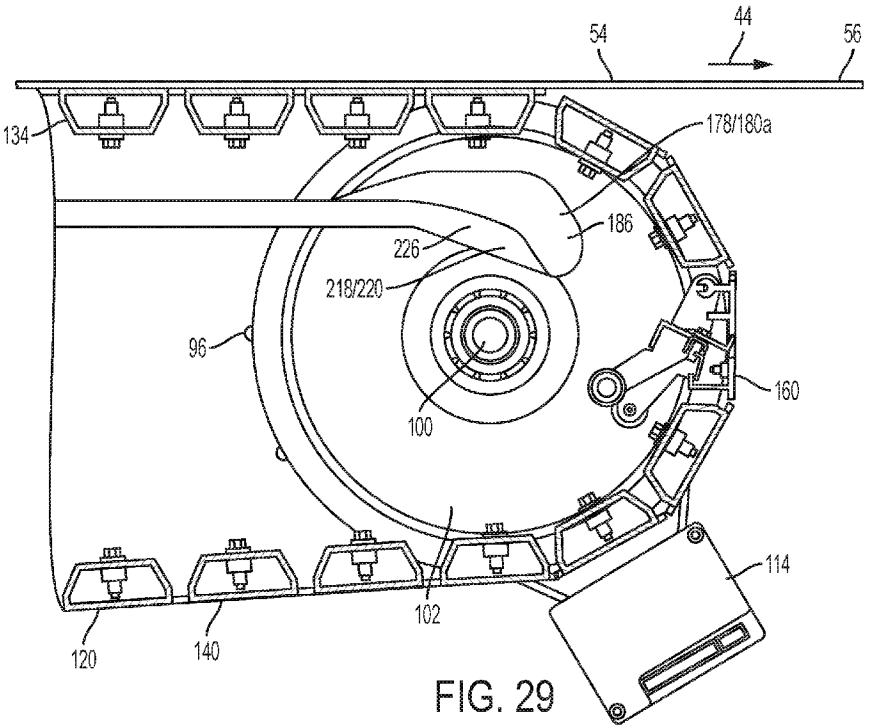
FIG. 29 is a side elevational detail cross-sectional view of the transport with media hold down of FIG. 6, taken along lines 10-10 of FIG. 6, and showing the left drive wheel, the left exit cams, and the spar in the retracted position orbiting past the exit cams.
Figure 30:
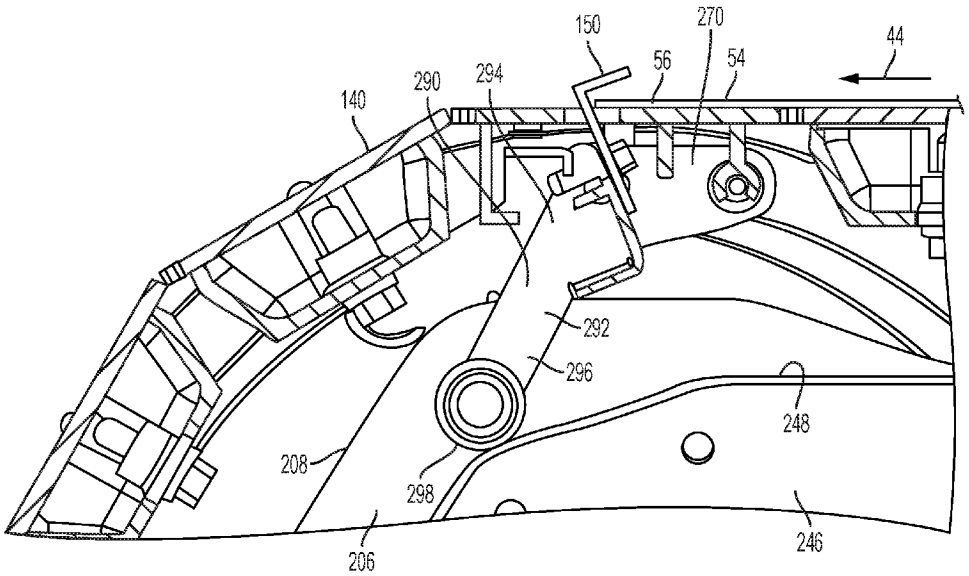
FIG. 30 is a side elevational detail, partial cross-sectional view of the transport with media hold down of FIG. 6, taken along lines 30-30 of FIG. 9, and showing the right drive wheel, the right exit cams, and the spar in the extended tilted position advancing in the process direction.
Figure 31:
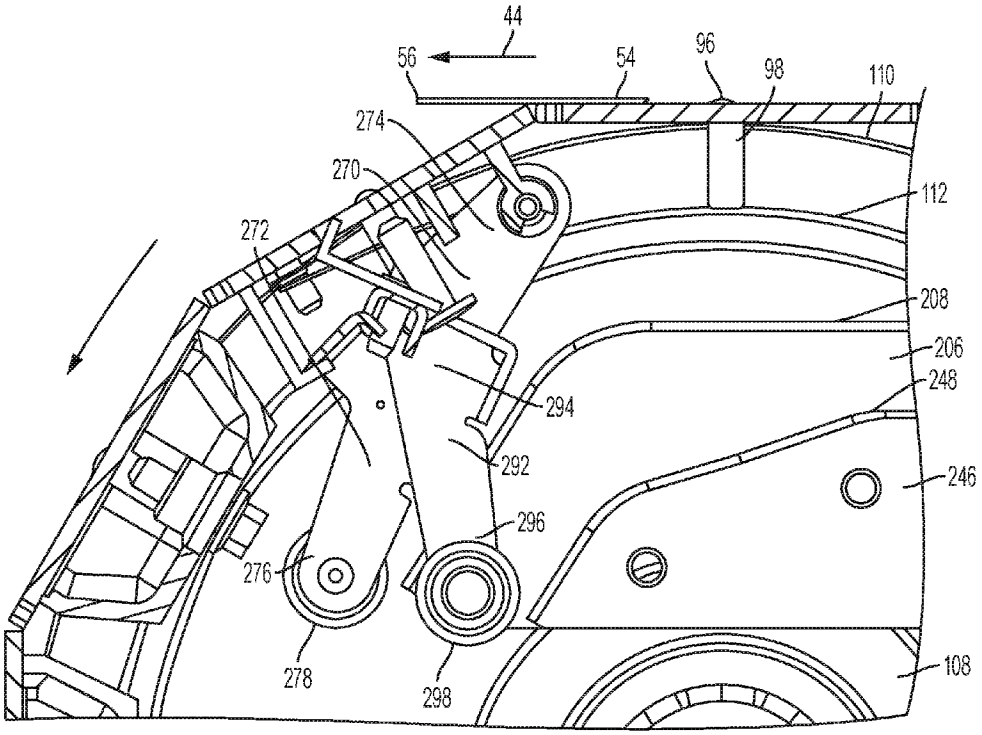
FIG. 31 is a side elevational detail, partial cross-sectional view of the transport with media hold down of FIG. 6, taken along lines 30-30 of FIG. 9, and showing the right drive wheel, the right exit cams, and the spar in the retracted position orbiting past the exit cams.

The right 270 and left 260 lift followers are adapted to next follow the right 208 and left 188 lift cam exit profiles respectively. The lift followers 260, 270 move the spar 150 from the clamping position shown in FIG. 25 to the extended position shown in FIG. 26 to unclamp the media sheet 54. The lift followers 260, 270 then move the spar 150 from the extended position to the retracted position shown in FIG. 28, allowing the media sheet 54 to exit the transport 70. This tuck, or retracted, position occurs so that the spar 150 will move ahead of the lead edge 56 of the sheet 54 that is exiting. This retracted position will prevent the spar 150 from catching and jamming the sheet 54 as it exits the transport 70.

At least one tilt follower is operatively connected to the at least one spar link 160. Typically, multiple spar links 160 are provided, as described above. Each spar link 160 has two tilt followers. Each spar 150 is typically mounted on the tilt followers.

A left tilt follower 280 is pivotally attached to the left lift follower 260. The left tilt follower 280 has two components, a lever and a roller. A left tilt lever 282 proximal end 284 is pivotally mounted on the left lift follower 260. The left tilt lever 282 distal end 286 has a left tilt roller 288 mounted for rotation. The left tilt roller 288 is in contact with the left tilt cam entry portion 222, and the left tilt track 230, and the left tilt cam exit portion 226. The spar mount flange 156 at the spar left end 152 is mounted on the left tilt follower 280. The spar mounting disclosed is non-limiting.

A right tilt follower 290 is pivotally attached to the right lift follower 270. The right tilt follower 290 has two components, a lever and a roller. A right tilt lever 292 proximal end 294 is pivotally mounted on the right lift follower 270. The right tilt lever 292 distal end 296 has a right tilt roller 298 mounted for rotation. The right tilt roller 298 is in contact with the right tilt cam entry portion 242, and the right tilt track 250, and the right tilt cam exit portion 246. The spar mount flange 156 at the spar right end 154 is mounted on the right tilt follower 290. The spar mounting disclosed is non-limiting.

The right 290 and left 280 tilt followers are adapted to follow the right 244 and left 224 tilt cam entry profiles respectively. Thus, the tilt followers 290, 280, move the spar 150 from the tilted position into the upright position shown in FIG. 22, prior to the clamping position shown in FIGS. 23-24. The tilted position allows the spar 150 to pass through the slot 164 in the spar link surface 162. After passing through the slot 164, the tilt followers 290, 280, move the spar 150 into the upright position.

The right 290 and left 280 tilt followers are adapted to follow the right 250 and left 230 tilt tracks respectively. Since the tilt tracks 230, 250, are straight, the spar 150 does not tilt in this region. This is proper, since the spar 150 is in the clamping position.

Figure 27:
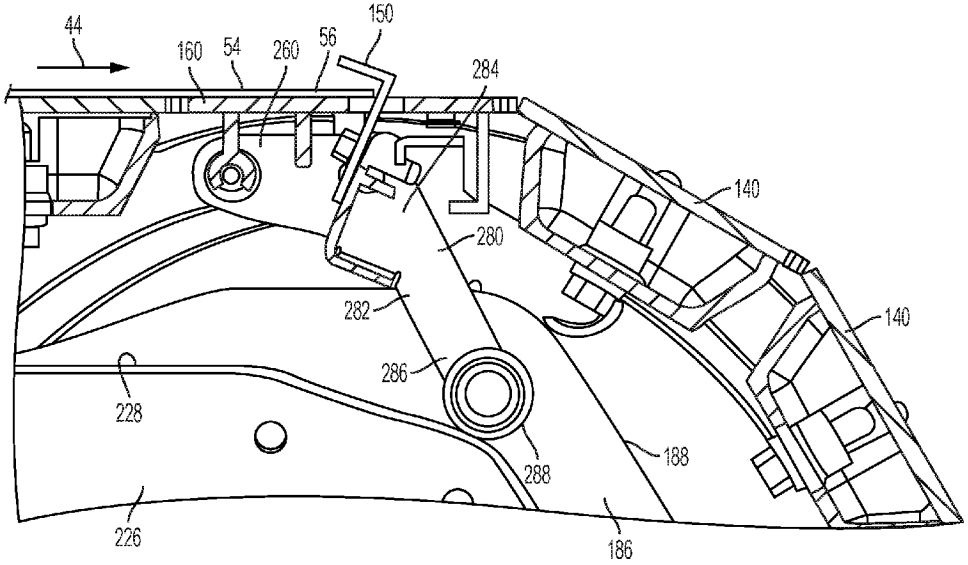
FIG. 27 is a side elevational detail cross-sectional view of the transport with media hold down of FIG. 6, taken along lines 10-10 of FIG. 6, and showing the left drive wheel, the left exit cams, and the spar in the extended tilted position.

The right 290 and left 280 tilt followers are adapted to follow the right 248 and left 228 tilt cam exit profiles respectively. The spar 150 thereby moves from the upright position shown in FIG. 26, into the tilted position shown in FIG. 27, prior to the retracted position shown in FIG. 28. Note that the spar 150 moves ahead of the lead edge 56 of the sheet 54 to prevent buckling of the sheet 54 on the endless belt 134. The tilted position allows the spar 150 to pass through the slot 164 in the spar link surface 162 so that the spar 150 can be retracted. The timing of the followers 260, 270, 280 and 290 around the cam orbital path determines elevation and tilt angle of the spar 150 for both entrance and exit portions.

A torsion spring (not shown) operatively connected to either the lift or tilt followers holds the spar 150 in the retracted position. The torsion spring provides the clamping force or bias exerted by the spar 150 on the sheet 54 during transport. The lift and tilt cams act upon the lift and tilt followers to overcome the spring bias.

A plurality of slides 308 is provided for sliding the transport 70 outward from the printer 40. The slides 308 are linear bearings that allow the transport 70 to move laterally out from under the marking engine 42 so as not to damage the print heads 43 during maintenance. This also allows easy access to the entire transport 70.

A method is disclosed for holding a media sheet 54 down on the transport 70. The method comprises connecting a plurality of links 120 pivotally together and orbiting the links 120 edgewise around drive wheels 102, 108, and driven wheels 84, 90. This will form an endless belt 134 defining the transport 70. The media sheet 54 is transported in the process direction 44 with the endless belt 134.

A spar 150 is movably mounted on at least one link 120 of the plurality of links. The spar 150 is moved into a clamping position with a cam 178, 218, and follower 260, 270, 280, 290. The media sheet lead edge 56 is clamped to the at least one link 120 by means of the spar 150. The media sheet 54 is held generally flat against the endless belt 134 surface with the spar 150 during printing. The spar 150 moves into an extended position with the cam and follower so as to release the media sheet. The spar 150 moves into a retracted position with the cam and follower so as to allow the media sheet 54 to exit the transport 70.

Adjacent links 120 are disposed together along two opposed generally parallel link edges 126 of each link 120. Each link 120 is extended between opposite ends 122, 124, transversely to the process direction 44. The at least one link 120 having the spar 150 is a spar link 160. The remaining links are vacuum links 140.

The spar 150 is formed into an L-shaped cross-section uniformly between opposite spar ends 152, 154. The cross-section has a spar mount flange 156 and a spar clamp flange 158. A spar link surface 162 faces outward from the spar link 160 and away from the endless belt 134. A slot 164 is extended through the spar link surface 162. The spar 150 is received in the slot 164.

The media sheet lead edge 56 is sandwiched between the clamp flange 158 and the spar link surface 162. The media sheet lead edge 56 is held clamped against the spar link surface 162 during printing. This allows the media sheet 54 to pass beneath the inkjet print head 43 without contacting the inkjet print head 43.

At least one flexible drive belt 170 is extended around the drive wheels 102, 108, and the driven wheels 84, 90. Each link 120 of the plurality of links is attached to the flexible drive belt 170, which pivotally connects each link together.

Each link 120 moves operatively in an orbital manner around the drive wheels 102, 108, and the driven wheels 84, 90 with the flexible drive belt 170. Serrations 128 are formed along each link edge 126. The serrations 128 are interlaced with corresponding serrations 128 on each adjacent link 120. The serrations 128 support the media sheet 54 transversely across the transport 70.

A vacuum plenum 138 is disposed beneath the endless belt 134. A vacuum source 139 communicates with the vacuum plenum 138 to supply vacuum. A vacuum link surface 142 faces outward from the vacuum link 140 and away from the endless belt 134. A hollow chamber 144 is attached to each vacuum link 140 below the link surface 142. The hollow chamber 144 is disposed above the vacuum plenum 138.

At least one aperture 146 is formed through the hollow chamber 144. The aperture 146 communicates with the vacuum plenum 138. A plurality of holes 148 is formed through the vacuum link surface 142. The holes 148 communicate with the hollow chamber 144. Vacuum is applied to the media sheet 54 through the plurality of holes 148. The vacuum serves to hold the media sheet 54 generally flat against the vacuum link surface 142 as the links 120 move over the vacuum plenum 138 in the process direction 44.

The media sheet 54 can be buckle registered by means of the spar 150. The registration would be achieved prior to clamping the media sheet lead edge 56 to the link 120 with the spar 150. A slot sensor (not shown) will be used to time the spar location and edge of sheet to create a start of print signal to register the image with respect to the lead edge of the sheet.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A transport with media hold down for use in connection with an inkjet printer having an inkjet print head, and a media sheet having a lead edge and a trail edge, the media sheet moving in a process direction along a process path, the transport with media hold down comprising:

a frame extending longitudinally in the process direction from a first end to an opposite second end;

at least one first axle mounted on the frame at the first end;

a pair of driven wheels mounted for rotation on the at least one first axle;

at least one second axle mounted on the frame at the second end;

a pair of drive wheels mounted for rotation on the at least one second axle;

at least one drive motor operatively driving at least one of the drive wheels;

a plurality of links operatively connected together, each link extending between opposite ends transversely to the process direction, each link having two opposed generally parallel link edges, each link edge being juxtaposed with an adjacent link edge on each adjacent link, the plurality of links being operatively drivingly attached to the drive wheels, each link being adapted for pivotal motion with respect to each adjacent link, each link having a link surface facing outward, the plurality of links being adapted for holding the media sheet generally flat against each link surface and conveying the media sheet in the process direction, at least one of the plurality of links being a spar link, and the remaining links being vacuum links;

at least one spar extending between opposite ends juxtaposed with the spar link opposite ends, the spar link having a spar link surface facing outward, the spar link having a slot extending through the spar link surface to receive the spar, the spar being adapted to move into a retracted position below the spar link surface, the spar being adapted to move into an extended position above the spar link surface, the spar having a clamp flange, the spar being adapted to move into a clamping position with the media sheet lead edge sandwiched between the clamp flange and the spar link surface, so as to hold the media sheet lead edge clamped against the spar link surface, wherein the media sheet will pass beneath the inkjet print head without contacting the inkjet print head;

at least one lift cam having an entry portion with an entry profile disposed adjacent the first end, the lift cam having an exit portion with an exit profile disposed adjacent the second end; and at least one lift follower attached to the at least one spar link, the spar being operatively connected to the lift follower; wherein the lift follower is adapted to follow the lift cam entry profile so as to move the spar from the retracted position to the extended position to receive the media sheet and to the clamping position to clamp the media sheet; and the lift follower is adapted to follow the lift cam exit profile so as to move the spar from the clamping position to the extended position to release the media sheet from the clamping position and to the retracted position, allowing the media sheet to exit the transport.

2. The transport with media hold down of claim 1, further comprising an endless belt formed by the plurality of links operatively connected together, the endless belt extending partway around the drive wheels and partway around the driven wheels, the endless belt extending between the drive wheels and the driven wheels, the endless belt being operatively drivingly attached to the drive wheels so as to be driven in an orbital motion around the drive wheels and the driven wheels.

3. The transport with media hold down of claim 2, further comprising:

a vacuum plenum disposed beneath the endless belt;

a vacuum source communicating with the vacuum plenum to supply vacuum;

wherein the vacuum links each further comprise:

a hollow chamber attached to the vacuum link below the link surface, the hollow chamber being disposed above the vacuum plenum, the hollow chamber having apertures therethrough communicating with the vacuum plenum; and a vacuum link surface facing outward away from the endless belt, the vacuum link surface having a plurality of holes therethrough communicating with the hollow chamber so as to apply vacuum to the media sheet for holding the media sheet generally flat against the vacuum link surface as the links move over the vacuum plenum in the process direction.

4. The transport with media hold down of claim 3, further comprising:

the pair of drive wheels further comprises a left drive wheel and a right drive wheel, the left and right drive wheels being mounted for rotation on the at least one second axle, the left and right drive wheels each having an outer rim with a circumference, an inner rim with a circumference, the inner rim being smaller in diameter than the outer rim, and a shoulder extending between the outer rim and the inner rim;

the pair of driven wheels further comprises a left driven wheel and a right driven wheel, the left and right driven wheels being mounted for rotation on the at least one first axle, the left and right driven wheels each having an outer rim with a circumference, an inner rim with a circumference, the inner rim being smaller in diameter than the outer rim, and a shoulder extending between the outer rim and the inner rim; and the vacuum links further comprise each vacuum link extending between a left end and an opposite right end, each vacuum link having a left tracking pin adjacent the left end, the left tracking pin being adapted to ride on the inner rim and against the shoulder of the left drive wheel and the left driven wheel, each vacuum link having a right tracking pin adjacent the right end, the right tracking pin being adapted to ride on the inner rim and against the shoulder of the right drive wheel and the right driven wheel, so as to retain the endless belt tracking generally centered on the transport.

5. The transport with media hold down of claim 2, wherein:

the pair of drive wheels further comprises a left drive wheel and a right drive wheel, the left and right drive wheels being mounted for rotation on the at least one second axle, the left and right drive wheels each having an outer rim with a circumference, each outer rim having a plurality of teeth projecting radially outward therefrom, the teeth being spaced uniformly apart around the circumference; and the plurality of links further comprises each link extending between a left end and an opposite right end, each link having a left drive hole adjacent the left end, the left drive hole being adapted to receive and release a one of the left drive wheel teeth, each link having a right drive hole adjacent the right end, the right drive hole being adapted to receive and release a one of the right drive wheel teeth, so as to operatively drivingly attach the endless belt to the drive wheels.

6. The transport with media hold down of claim 1, further comprising at least one flexible drive belt attached to each link of the plurality of links to pivotally connect each link together and adapted to operatively move the plurality of links in an orbital motion around the drive wheels and the driven wheels.

7. The transport with media hold down of claim 1, further comprising:

at least one tilt cam having an entry portion with an entry profile juxtaposed with the lift cam entry portion, the tilt cam having an exit portion with an exit profile juxtaposed with the lift cam exit portion; and at least one tilt follower operatively connected to the at least one spar link, the spar being mounted on the tilt follower; wherein the spar is adapted to move into a tilted position, so as to pass through the spar link slot and into an upright position prior to the clamping position;

the tilt follower is adapted to follow the tilt cam entry profile so as to move the spar from the tilted position into the upright position; and the tilt follower is adapted to follow the tilt cam exit profile so as to move the spar from the upright position into the tilted position prior to the retracted position.

8. The transport with media hold down of claim 7, further comprising:

a lift track extending between the lift cam entry portion and the lift cam exit portion; and a tilt track extending between the tilt cam entry portion and the tilt cam exit portion; wherein the lift follower is adapted to follow the lift track so as to retain the spar in the clamping position; and the tilt follower is adapted to follow the tilt track so as to retain the spar in the upright position.

9. The transport with media hold down of claim 8, wherein:

the spar further comprises a mount flange and a clamp flange forming an L-shaped cross-section extending uniformly between the spar ends;

the at least one lift follower is pivotally attached to the at least one spar link;

the at least one tilt follower is pivotally attached to the lift follower; and the spar mount flange is mounted on the tilt follower.

10. The transport with media hold down of claim 1, further comprising:

each link extending between a left end and an opposite right end;

a right flexible drive belt attached to each link adjacent the right end; and a left flexible drive belt attached to each link adjacent the left end; wherein the left and right flexible drive belts pivotally connect each link together and are adapted to operatively move the plurality of links in an orbital motion around the drive wheels and the driven wheels.

11. A transport with media hold down for use in connection with an inkjet printer having an inkjet print head, and a media sheet having a lead edge and a trail edge, the media sheet moving in a process direction along a process path, the transport with media hold down comprising:

a pair of side frames generally parallel and spaced apart, the side frames extending longitudinally in the process direction between opposite first and second ends, the second ends being downstream in the process direction from the first ends;

at least one cross frame extending transversely between the side frames;

at least one first axle mounted on the side frames at the first ends;

a pair of driven wheels mounted for rotation on the at least one first axle;

at least one second axle mounted on the side frames at the second ends;

a pair of drive wheels mounted for rotation on the at least one second axle;

at least one drive motor operatively driving at least one of the drive wheels;

a plurality of links, each link extending between opposite ends transversely to the process direction, the opposite ends being disposed adjacent the side frames, each link having two opposed generally parallel link edges extending transverse to the side frames, each link edge having serrations interlaced with corresponding serrations along the link edge on each adjacent link, so as to support the media sheet transversely across the transport;

at least one flexible drive belt attached to each link of the plurality of links to pivotally connect each link together, the flexible drive belt being adapted to operatively move the plurality of links in an orbital motion around the drive wheels and the driven wheels;

an endless belt formed by the plurality of links operatively connected together, the endless belt extending partway around the drive wheels and partway around the driven wheels, the endless belt extending between the drive wheels and the driven wheels, the endless belt being operatively drivingly attached to the drive wheels, each link having a link surface facing outward away from the endless belt, the plurality of links being adapted for holding the media sheet generally flat against each link surface and conveying the media sheet in the process direction, at least one of the plurality of links being a spar link, and the remaining links being vacuum links;

at least one spar extending between opposite ends juxtaposed with the spar link opposite ends, the spar being coextensive with the one of the plurality of links defining the spar link, the spar link having a spar link surface facing outward away from the endless belt, the spar link having a slot extending through the spar link surface to receive the spar, the spar being adapted to move into a retracted position below the spar link surface, the spar being adapted to move into an extended position above the spar link surface, the spar being L-shaped in cross-section uniformly between the spar ends, the spar having a mount flange and a clamp flange forming the L-shape, the spar being adapted to move into a clamping position with the media sheet lead edge sandwiched between the clamp flange and the spar link surface, so as to hold the media sheet lead edge clamped against the spar link surface, wherein the media sheet will pass beneath the inkjet print head without contacting the inkjet print head;

at least one lift cam having an entry portion with an entry profile, and an exit portion with an exit profile, and a lift track extending between the entry portion and the exit portion, the lift cam lying generally in a plane generally parallel to the side frames, the entry portion being juxtaposed with a one of the driven wheels and the exit portion being juxtaposed with a corresponding one of the drive wheels; and at least one lift follower attached to the at least one spar link, the spar being operatively connected to the lift follower; wherein the lift follower is adapted to follow the lift cam entry profile so as to move the spar from the retracted position to the extended position to receive the media sheet and to the clamping position to clamp the media sheet;

the lift follower is adapted to follow the lift track so as to retain the spar in the clamping position; and the lift follower is adapted to follow the lift cam exit profile so as to move the spar from the clamping position to the extended position to release the media sheet from the clamping position and to the retracted position, allowing the media sheet to exit the transport.

12. The transport with media hold down of claim 11, further comprising:

at least one tilt cam having an entry portion with an entry profile, and an exit portion with an exit profile, and a tilt track extending between the entry portion and the exit portion, the tilt cam lying generally in a plane generally parallel to the lift cam, the tilt cam entry portion being juxtaposed with the lift cam entry portion and the tilt cam exit portion being juxtaposed with the lift cam exit portion; and at least one tilt follower operatively connected to the at least one spar link, the spar being mounted on the tilt follower; wherein the spar is adapted to move into a tilted position, so as to pass through the spar link slot and into an upright position prior to the clamping position;

the tilt follower is adapted to follow the tilt cam entry profile so as to move the spar from the tilted position into the upright position;

the tilt follower is adapted to follow the tilt track; and the tilt follower is adapted to follow the tilt cam exit profile so as to move the spar from the upright position into the tilted position prior to the retracted position.

13. The transport with media hold down of claim 12, wherein:

the at least one lift follower is pivotally attached to the at least one spar link;

the at least one tilt follower is pivotally attached to the lift follower; and the spar mount flange is mounted on the tilt follower.

14. The transport with media hold down of claim 11, further comprising:

a vacuum plenum disposed beneath the endless belt;

a vacuum source communicating with the vacuum plenum to supply vacuum;

wherein the vacuum links each further comprise:

a hollow chamber attached to the link below the link surface, the hollow chamber being disposed above the vacuum plenum, the hollow chamber having apertures therethrough communicating with the vacuum plenum; and a vacuum link surface facing outward away from the endless belt, the vacuum link surface having a plurality of holes therethrough communicating with the hollow chamber so as to apply vacuum to the media sheet for holding the media sheet generally flat against the vacuum link surface as the links move over the vacuum plenum in the process direction.

15. The transport with media hold down of claim 11, wherein:

the pair of drive wheels further comprises a left drive wheel and a right drive wheel, the left and right drive wheels being mounted for rotation on the at least one second axle, the left and right drive wheels each having an outer rim with a circumference, each outer rim having a plurality of teeth projecting radially outward therefrom, the teeth being spaced uniformly apart around the circumference; and the plurality of links further comprises each link extending between a left end disposed adjacent the left side frame and an opposite right end disposed adjacent the right side frame, each link having a left drive hole adjacent the left end and a right drive hole adjacent the right end, the left drive hole being adapted to receive and release a one of the left drive wheel teeth, the right drive hole being adapted to receive and release a one of the right drive wheel teeth, so as to operatively drivingly attach the endless belt to the drive wheels.

16. The transport with media hold down of claim 14, further comprising:

the pair of drive wheels further comprises a left drive wheel and a right drive wheel, the left and right drive wheels being mounted for rotation on the at least one second axle, the left and right drive wheels each having an outer rim with a circumference, an inner rim with a circumference, the inner rim being smaller in diameter than the outer rim, and a shoulder extending between the outer rim and the inner rim;

the pair of driven wheels further comprises a left driven wheel and a right driven wheel, the left and right driven wheels being mounted for rotation on the at least one first axle, the left and right driven wheels each having an outer rim with a circumference, an inner rim with a circumference, the inner rim being smaller in diameter than the outer rim, and a shoulder extending between the outer rim and the inner rim; and the vacuum links further comprise each vacuum link extending between a left end disposed adjacent the left side frame and an opposite right end disposed adjacent the right side frame, each vacuum link having a left tracking pin adjacent the left end and a right tracking pin adjacent the right end, the left tracking pin being adapted to ride on the inner rim and against the shoulder of the left drive wheel and the left driven wheel, the right tracking pin being adapted to ride on the inner rim and against the shoulder of the right drive wheel and the right driven wheel, so as to retain the endless belt tracking generally centered on the transport.

17. The transport with media hold down of claim 11, further comprising:

a right flexible drive belt attached to each link adjacent the link right end; and a left flexible drive belt attached to each link adjacent the link left end, the left and right flexible drive belts pivotally connecting each link together and being adapted to operatively move the plurality of links in an orbital motion around the drive wheels and the driven wheels.

18. The transport with media hold down of claim 11, wherein:

the pair of driven wheels further comprises a left driven wheel and a right driven wheel, the wheels being mounted for rotation on the at least one first axle;

the pair of drive wheels further comprises a left drive wheel and a right drive wheel, the wheels being mounted for rotation on the at least one second axle;

wherein the left driven wheel is aligned with the left drive wheel in the process direction, and the right driven wheel is aligned with the right drive wheel in the process direction;

the pair of side frames further comprises a left side frame and a right side frame;

the at least one lift cam further comprises:

a left lift cam having an entry portion with an entry profile, and an exit portion with an exit profile, and a left lift track extending between the entry portion and the exit portion, the left lift cam lying generally in a plane generally parallel to the left side frame, the left lift cam entry portion being juxtaposed with the left driven wheel and the left lift cam exit portion being juxtaposed with the left drive wheel;

a right lift cam having an entry portion with an entry profile, and an exit portion with an exit profile, and a right lift track extending between the entry portion and the exit portion, the right lift cam lying generally in a plane generally parallel to left lift cam, the right lift cam entry portion being juxtaposed with the right driven wheel and the right lift cam exit portion being juxtaposed with the right drive wheel;

the plurality of links further comprises each link extending between a left end disposed adjacent the left side frame and an opposite right end disposed adjacent the right side frame;

the at least one spar further comprises the spar extending between a spar left end disposed adjacent the spar link left end and an opposite spar right end disposed adjacent the spar link right end, the spar mount flange extending between the spar left end and the spar right end, the spar clamp flange extending between the spar left end and the spar right end, the spar clamp flange being disposed at generally a right angle to the spar mount flange;

the at least one lift follower further comprises:

a left lift follower pivotally attached to the spar link left end, the spar left end being operatively connected to the left lift follower; and a right lift follower pivotally attached to the spar link right end, the spar right end being operatively connected to the right lift follower; wherein the right and left lift followers are adapted to follow the right and left lift cam entry profiles respectively, so as to move the spar from the retracted position to the extended position and to the clamping position to clamp the media sheet;

the right and left lift followers are adapted to follow the right and left lift tracks respectively, so as to retain the spar in the clamping position; and the right and left lift followers are adapted to follow the right and left lift cam exit profiles respectively, so as to move the spar from the clamping position to the extended position to unclamp the media sheet and to move the spar from the extended position to the retracted position, allowing the media sheet to exit the transport.

19. The transport with media hold down of claim 18, wherein:

the at least one tilt cam further comprises:

a left tilt cam having an entry portion with an entry profile, and an exit portion with an exit profile, and a left tilt track extending between the entry portion and the exit portion, the left tilt cam lying generally in a plane generally parallel to the left lift cam, the left tilt cam entry portion being juxtaposed with the left lift cam entry portion and the left tilt cam exit portion being juxtaposed with the left lift cam exit portion; and a right tilt cam having an entry portion with an entry profile, and an exit portion with an exit profile, and a right tilt track extending between the entry portion and the exit portion, the right tilt cam lying generally in a plane generally parallel to the right lift cam, the right tilt cam entry portion being juxtaposed with the right lift cam entry portion and the right tilt cam exit portion being juxtaposed with the right lift cam exit portion;

the at least one tilt follower further comprises:

a left tilt follower pivotally attached to the left lift follower, the mount flange at the spar left end being mounted on the left tilt follower; and a right tilt follower pivotally attached to the right lift follower, the mount flange at the spar right end being mounted on the right tilt follower; wherein the right and left tilt followers are adapted to follow the right and left tilt cam entry profiles respectively, so as to move the spar from the tilted position into the upright position prior to the clamping position;

the right and left tilt followers are adapted to follow the right and left tilt tracks respectively; and the right and left tilt followers are adapted to follow the right and left tilt cam exit profiles respectively, so as to move the spar from the upright position into the tilted position prior to the retracted position.

20. A method for holding a media sheet down on a transport, for use in connection with an inkjet printer having an inkjet print head, and a media sheet having a lead edge and a trail edge, the media sheet moving in a process direction along a process path, the method comprising:

connecting a plurality of links pivotally together and orbiting the links edgewise around drive wheels and driven wheels to form an endless belt defining the transport;

transporting the media sheet in the process direction with the endless belt;

mounting a spar movably on at least one link of the plurality of links;

moving the spar into a clamping position with a cam and follower;

clamping the media sheet lead edge to the at least one link with the spar;

holding the media sheet generally flat against the endless belt surface with the spar during printing;

moving the spar into an extended position with the cam and follower so as to release the media sheet;

moving the spar into a retracted position with the cam and follower so as to allow the media sheet to exit the transport;

disposing adjacent links together along two opposed generally parallel link edges of each link, and extending each link between opposite ends transversely to the process direction, wherein the at least one link having the spar is a spar link, and the remaining links are vacuum links;

forming the spar into an L-shaped cross-section uniformly between opposite spar ends, wherein the cross-section has a spar mount flange and a spar clamp flange;

facing a spar link surface outward from the spar link and away from the endless belt;

extending a slot through the spar link surface and receiving the spar in the slot;

sandwiching the media sheet lead edge between the clamp flange and the spar link surface;

holding the media sheet lead edge clamped against the spar link surface during printing; and allowing the media sheet to pass beneath the inkjet print head without contacting the inkjet print head.

21. The method of claim 20, further comprising:

extending at least one flexible drive belt around the drive wheels and the driven wheels;

attaching each link of the plurality of links to the flexible drive belt so as to pivotally connect each link together;

operatively moving the plurality of links orbitally around the drive wheels and the driven wheels with the flexible drive belt; and forming serrations along each link edge and interlacing the serrations with corresponding serrations on each adjacent link, so as to support the media sheet transversely across the transport.

22. The method of claim 21, further comprising:

disposing a vacuum plenum beneath the endless belt;

communicating a vacuum source with the vacuum plenum to supply vacuum;

facing a vacuum link surface outward from the vacuum link and away from the endless belt;

attaching a hollow chamber to each vacuum link below the link surface;

disposing the hollow chamber above the vacuum plenum;

forming at least one aperture through the hollow chamber and communicating the aperture with the vacuum plenum;

forming a plurality of holes through the vacuum link surface and communicating the holes with the hollow chamber; and applying vacuum to the media sheet through the plurality of holes so as to hold the media sheet generally flat against the vacuum link surface as the links move over the vacuum plenum in the process direction.

23. The method of claim 22, further comprising buckle registering the media sheet with the spar prior to clamping the media sheet lead edge to the link with the spar.

24. A transport with media hold down for use in connection with an inkjet printer having an inkjet print head, and a media sheet having a lead edge and a trail edge, the media sheet moving in a process direction along a process path, the transport with media hold down comprising:

a pair of driven wheels;

a pair of drive wheels spaced apart from the driven wheels;

a plurality of links connected pivotally together to form an endless belt adapted for orbiting around the drive wheels and the driven wheels, wherein:

at least one of the plurality of links is a spar link having a spar link surface facing away from the endless belt, the spar link having a spar link slot; and the remaining links are vacuum links, each having a hollow chamber communicating with a vacuum source, so as to hold the media sheet against the endless belt;

a cam disposed adjacent the endless belt;

a follower adapted to operatively follow the cam; and at least one spar movably mounted on the spar link and received in the spar link slot, the spar being operatively connected to the follower, the spar having a clamp flange;

wherein:

the spar is adapted to move into an extended position above the spar link surface by the cam and follower so as to receive the media sheet;

the spar is adapted to move into a clamping position by the cam and follower with the media sheet lead edge sandwiched between the clamp flange and the spar link surface, so as to hold the media sheet lead edge clamped against the spar link surface, wherein the media sheet will pass beneath the inkjet print head without contacting the inkjet print head;

the spar is adapted to move into the extended position by the cam and follower so as to release the media sheet; and the spar is adapted to move into a retracted position below the spar link surface by the cam and follower so as to allow the media sheet to exit the transport.

* * * * *